US010870271B2

(12) United States Patent
Kamibayashi et al.

(10) Patent No.: US 10,870,271 B2
(45) Date of Patent: Dec. 22, 2020

(54) LIQUID EJECTING APPARATUS AND METHOD FOR DRIVING THE SAME

(71) Applicant: SEIKO EPSON CORPORATION, Tokyo (JP)

(72) Inventors: Masashi Kamibayashi, Matsumoto (JP); Eishin Yoshikawa, Shiojiri (JP); Yuji Hatanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/715,901

(22) Filed: Dec. 16, 2019

(65) Prior Publication Data

US 2020/0189268 A1 Jun. 18, 2020

(30) Foreign Application Priority Data

Dec. 17, 2018 (JP) ..... 2018-235181

(51) Int. Cl.
*B41J 2/045* (2006.01)

(52) U.S. Cl.
CPC ..... *B41J 2/0451* (2013.01); *B41J 2/04581* (2013.01)

(58) Field of Classification Search
CPC .. B41J 2/0451; B41J 2/04581; B41J 2/04551; B41J 2/0456; B41J 2/04558; B41J 2/2142; B41J 2/2139; B41J 2/14; B41J 2/145; B41J 2/155; B41J 2/2132; B41J 2/2145

See application file for complete search history.

(56) References Cited

U.S. PATENT DOCUMENTS

| | | | | |
|---|---|---|---|---|
| 10,369,784 | B2 | 8/2019 | Kayahara et al. | |
| 2009/0085952 | A1* | 4/2009 | Yamazaki | |
| 2009/0225125 | A1* | 9/2009 | Hoki | B41J 2/2142 |
| 2017/0190191 | A1 | 7/2017 | Yoshikawa | |
| 2018/0134032 | A1 | 5/2018 | Nozawa | |
| 2018/0207937 | A1* | 7/2018 | Sugaya et al. | B41J 2/2142 |
| 2018/0225555 | A1 | 8/2018 | Doi | |
| 2018/0304625 | A1 | 10/2018 | Kayahara et al. | |

FOREIGN PATENT DOCUMENTS

| | | |
|---|---|---|
| EP | 3392046 | 10/2018 |
| JP | 2004-174816 | 6/2004 |
| JP | 2018-079633 | 5/2018 |
| JP | 2018-122533 | 5/2018 |
| JP | 2018-122568 | 8/2018 |

* cited by examiner

*Primary Examiner* — Juanita D Jackson
(74) *Attorney, Agent, or Firm* — Workman Nydegger

(57) ABSTRACT

A liquid ejecting apparatus includes a liquid ejecting head having N nozzle line groups (N is an integer equal to or larger than 3) arranged in a first direction, a main scanning section configured to move the liquid ejecting head in a second direction which intersects with the first direction for scanning, a selection section configured to select a set of use nozzle lines to be used for formation of dots on the medium from among the N nozzle line groups, and an ejection controller configured to form the dots by causing the nozzles included in the set of use nozzle lines selected by the selection section to eject the liquid. The selection section selects M of the N nozzle line groups (2≤M<N) which are consecutively adjacent to each other in the first direction as the set of use nozzle lines.

8 Claims, 10 Drawing Sheets

FIG. 7

| NOZZLE LINE GROUP | SET OF USE NOZZLE LINES | | | | | | | | | |
|---|---|---|---|---|---|---|---|---|---|---|
| | A | B | C | D | E | F | G | H | I | J |
| Ch1 | USE | NON-USE | USE | NON-USE | NON-USE | USE | NON-USE | NON-USE | NON-USE | USE |
| Ch2 | USE | USE | USE | NON-USE | USE | USE | NON-USE | NON-USE | USE | NON-USE |
| Ch3 | USE | USE | USE | USE | USE | NON-USE | NON-USE | USE | NON-USE | NON-USE |
| Ch4 | USE | USE | NON-USE | USE | NON-USE | NON-USE | USE | NON-USE | NON-USE | NON-USE |

D1 HIGH PRIORITY LOW

LIQUID EJECTING APPARATUS AND METHOD FOR DRIVING THE SAME

The present application is based on, and claims priority from JP Application Serial Number 2018-235181, filed Dec. 17, 2018, the disclosure of which is hereby incorporated by reference herein in its entirety.

BACKGROUND

1. Technical Field

The present disclosure relates to a liquid ejecting apparatus and a method for driving the liquid ejecting apparatus.

2. Related Art

Liquid ejecting apparatuses, such as ink jet printers, include a recording head which ejects liquid to a recording medium or the like. The recording head has a large number of nozzles. In such a liquid ejecting apparatus, in a case where ejection of liquid fails in a number of the nozzles, the other nozzles which appropriately eject liquid record dots to be recorded by the nozzles of the ejection failure instead so that degradation of print image quality is suppressed (refer to JP-A-2004-174816).

However, there arises a problem in that, when the technique disclosed in JP-A-2004-174816 is used, if the ejection failure occurs in a large number of nozzles, dots may not be formed only by the other normal nozzles. In this case, the recording head is required to be replaced. A user may not perform printing while the recording head is replaced, and therefore, reproducibility of printing matters is degraded. Such a problem also occurs in not only the ink jet printers but also liquid ejecting apparatuses which eject arbitrary liquid other than ink.

SUMMARY

According to an aspect of the present disclosure, a liquid ejecting apparatus is provided. The liquid ejecting apparatus includes a liquid ejecting head having N nozzle line groups (N is an integer equal to or larger than 3) in a first direction each of which includes at least one nozzle line having a plurality of nozzles which eject liquid on a medium, a main scanning section configured to move the liquid ejecting head in a second direction which intersects with the first direction for scanning, a selection section configured to select a set of use nozzle lines to be used for formation of dots on the medium from among the N nozzle line groups, and an ejection controller configured to form the dots by causing the nozzles included in the set of use nozzle lines selected by the selection section to eject the liquid. The selection section selects M of the N nozzle line groups ($2 \leq M < N$) which are consecutively adjacent to each other in the first direction as the set of use nozzle lines.

According to another aspect of the present disclosure, there is provided a method for driving a liquid ejecting apparatus including a liquid ejecting head having N nozzle line groups (N is an integer equal to or larger than 3) in a first direction each of which includes at least one nozzle line having a plurality of nozzles which eject liquid on a medium and a main scanning section configured to move the liquid ejecting head in a second direction which intersects with the first direction for scanning. In the driving method, information indicating whether dots are to be formed on the medium only using selected nozzle line groups among the N nozzle line groups is displayed in a selectable manner, and when it is determined that the dots are to be formed, the dots are formed using a set of M of the nozzle line groups ($2 \leq M < N$) which are consecutively adjacent to each other in the first direction.

BRIEF DESCRIPTION OF THE DRAWINGS

FIG. 7 is a diagram illustrating examples of sets of use nozzle lines.

DESCRIPTION OF EXEMPLARY EMBODIMENTS

A. First Embodiment

A1. Apparatus Configuration

Figure 1:
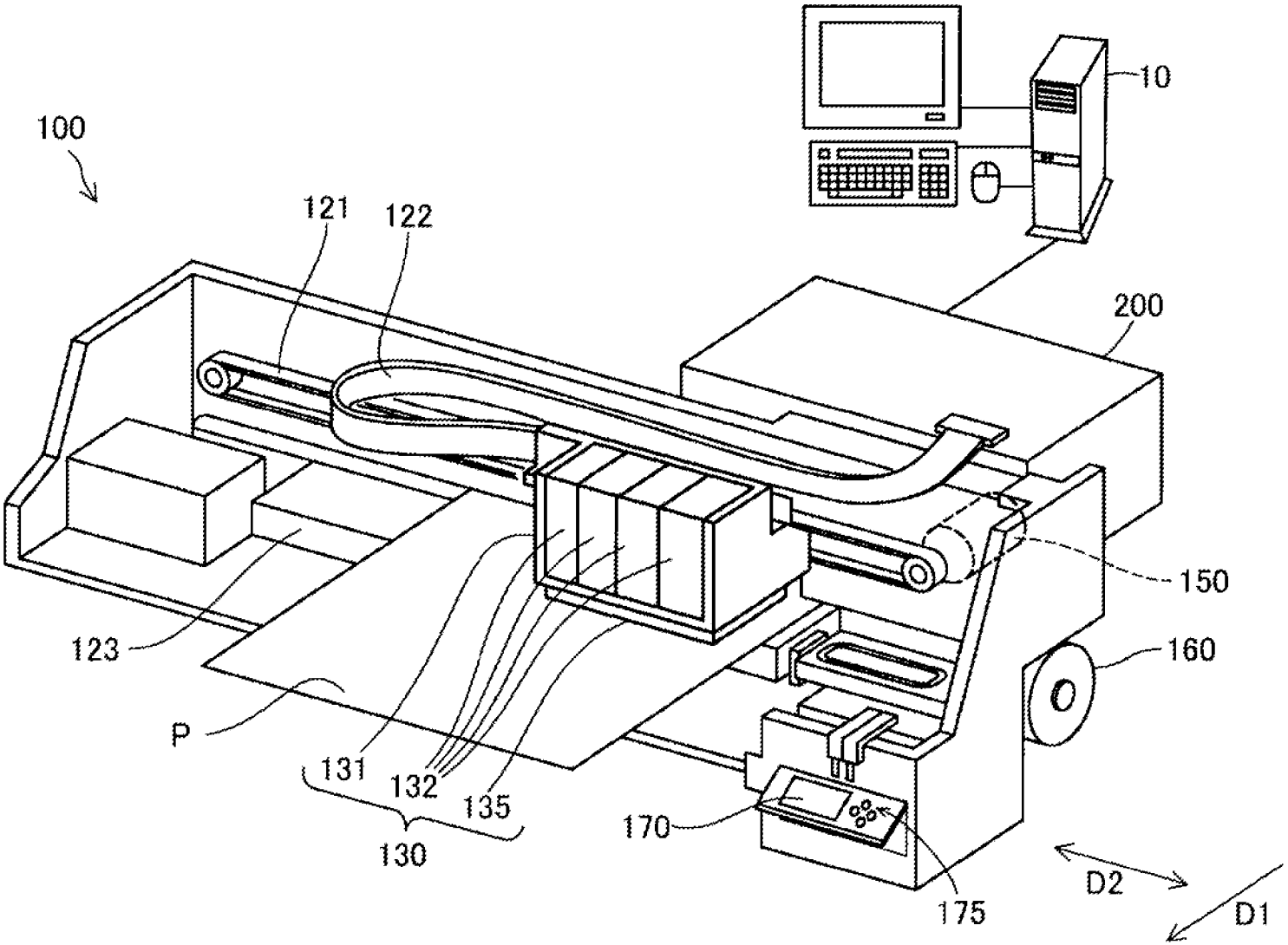
FIG. 1 is a diagram schematically illustrating a configuration of a liquid ejecting apparatus.

FIG. 1 is a diagram schematically illustrating a configuration of a liquid ejecting apparatus 100 according to an embodiment of the present disclosure. The liquid ejecting apparatus 100 is configured as an ink jet printer which ejects ink. The liquid ejecting apparatus 100 converts image data received from a liquid ejecting control apparatus 10 into print data indicating an On state or an Off state of dots on a medium P and ejects ink from a plurality of nozzles on the medium P based on the print data as dots on the medium P so as to print an image or the like.

In FIG. 1, the liquid ejecting control apparatus 10 is illustrated in addition to the liquid ejecting apparatus 100. The liquid ejecting control apparatus 10 is available for communication with the liquid ejecting apparatus 100 and transmits image data to be printed to the liquid ejecting apparatus 100 so as to cause the liquid ejecting apparatus 100 to execute printing. In this embodiment, the liquid ejecting control apparatus 10 is configured by a computer.

The liquid ejecting apparatus 100 includes a head unit 130, a carriage motor 150, a transport motor 160, a driving belt 121, a flexible cable 122, a platen 123, a controller 200, a display section 170, and an operation section 175.

The transport motor 160 is driven in response to a control signal supplied from the controller 200. When a driving force of the transport motor 160 is transmitted to a transport roller, not illustrated, the medium P is transported in a sub-scanning direction D1. In FIG. 1, the medium P is transported from an upstream side to a downstream side in the sub-scanning direction D1.

The head unit 130 includes a carriage 131 and a liquid ejecting head 135 mounted on the carriage 131. Four ink cartridges 132 for different colors are attached to the head unit 130 in a detachable manner. In this embodiment, the four ink cartridges 132 individually include an ink of cyan, an ink of magenta, an ink of yellow, and an ink of black. The liquid ejecting head 135 includes a plurality of nozzle lines which eject ink to a surface of the medium P which faces the liquid ejecting head 135. The ink supplied from the ink cartridges 132 to the liquid ejecting head 135 is ejected from nozzles Nz as droplets.

The head unit 130 is electrically connected to the controller 200 through the flexible cable 122. The carriage 131 is attached so as to reciprocate in a main scanning direction D2 along a carriage guide shaft not illustrated. The carriage 131 is connected to the carriage motor 150 through the driving belt 121 and reciprocates in the main scanning direction D2 along with rotation of the carriage motor 150. The carriage 131, the carriage motor 150, the driving belt 121, and the carriage guide shaft are subordinate concepts of a main scanning section in Summary.

When generation of print data is completed, the controller 200 drives the transport motor 160 so that the medium P is transported to a print start position in the sub-scanning direction D1. The controller 200 drives the carriage motor 150 so that the head unit 130 is moved to a print start position in the main scanning direction D2. The controller 200 alternately performs control for causing the head unit 130 to move in the main scanning direction D2 and causing the head unit 130 to eject ink to the medium P and control on the transport motor 160 for transporting the medium P in the sub-scanning direction D1 which is a print direction. An image is thus printed on the medium P. Note that the head unit 130 reciprocates in the main scanning direction D2 and the medium P is transported from the upstream side to the downstream side in the sub-scanning direction D1 which intersects with the main scanning direction D2 in FIG. 1. In this embodiment, the sub-scanning direction D1 orthogonally intersects with the main scanning direction D2. Furthermore, in this embodiment, the sub-scanning direction D1 is a subordinate concept of a first direction in Summary. The main scanning direction D2 is a subordinate concept of a second direction in Summary.

The display section 170 is used to perform various operations associated with the liquid ejecting apparatus 100. The display section 170 includes a large liquid crystal screen which displays a menu screen when various functions of the liquid ejecting apparatus 100 are to be used and an information screen used when a notification indicating malfunction, an error, or the like is displayed for the user. The liquid ejecting apparatus 100 is controlled based on a user instruction input by operating the operation section 175 described below. An operation screen for a nozzle restriction mode setting process described below, for example, is displayed in the menu screen described above. Note that the display section 170 may be included in the liquid ejecting control apparatus 10.

The operation section 175 is a user interface used to operate the menu screen displayed in the display section 170. The user may perform various settings in the display section 170 by operating the operation section 175. Note that the operation section 175 may be included in the liquid ejecting control apparatus 10.

Figure 2:
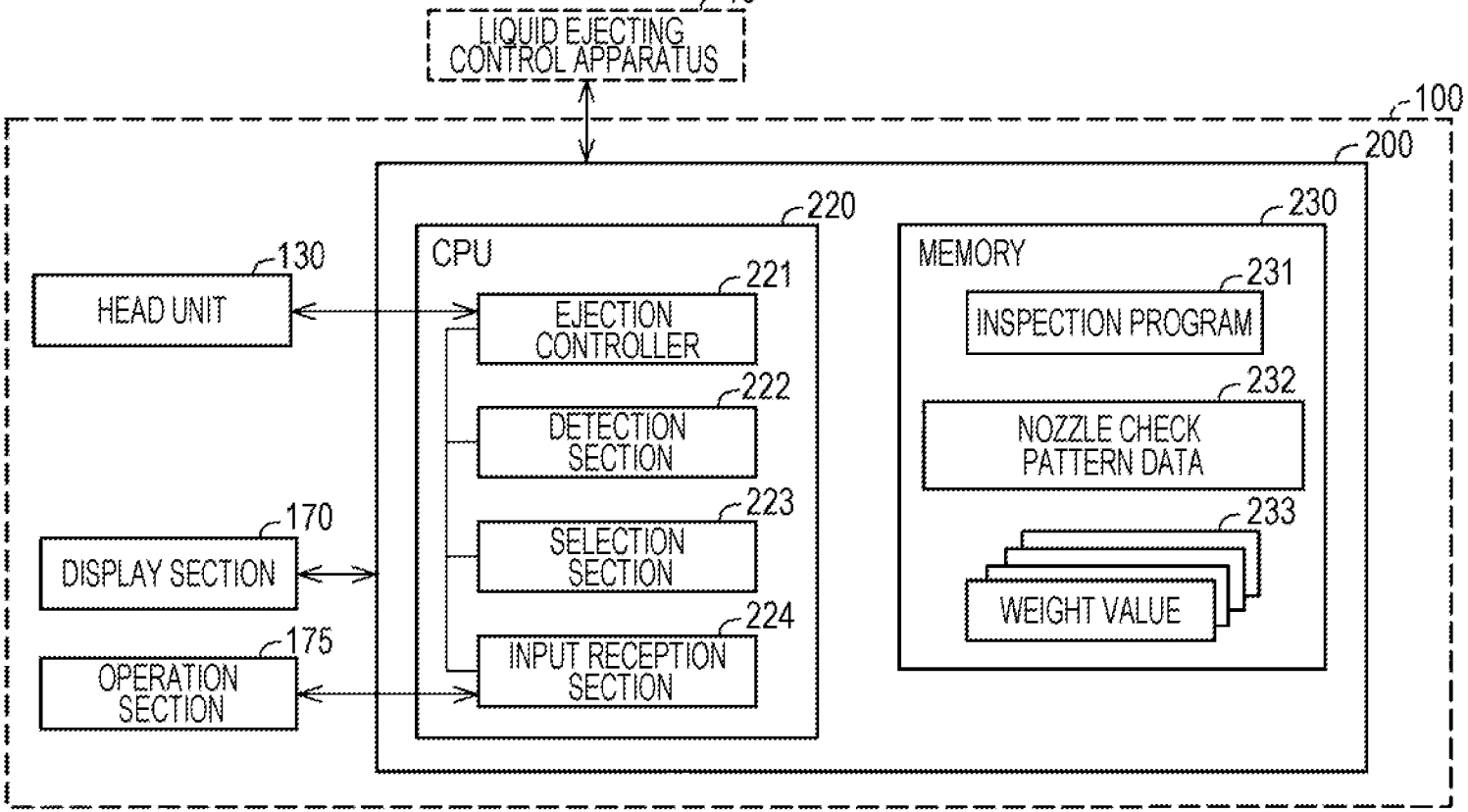
FIG. 2 is a block diagram illustrating a configuration of a controller.

FIG. 2 is a block diagram illustrating a configuration of the controller 200. The controller 200 controls the entire liquid ejecting apparatus 100. The controller 200 includes a central processing unit (CPU) 220 and a memory 230. The CPU 220 and the memory 230 are connected to each other through an internal bus so as to communicate with each other in a bidirectional manner. The memory 230 includes a read only memory (ROM), a random access memory (RAM), and an electrically erasable programmable read only memory (EEPROM).

The CPU 220 functions as an ejection controller 221, a detection section 222, a selection section 223, and an input reception section 224 by executing control programs stored in the memory 230 in advance.

The ejection controller 221 generates print data PD using image data supplied from the liquid ejecting control apparatus 10 and transmits the print data PD to the head unit 130. In the process of generating print data, the ejection controller 221 generates print data including a command for print control by performing general processes including a resolution conversion process, a color dividing print process (a color conversion process), a halftone process, and a rasterizing process on the print data supplied from the liquid ejecting control apparatus 10. Note that these processes may be performed by the liquid ejecting control apparatus 10 and the liquid ejecting apparatus 100 may receive the print data PD, or the print data PD may be generated by dividing these processes by the liquid ejecting control apparatus 10 and the liquid ejecting apparatus 100.

The ejection controller 221 controls the transport motor 160 so as to control supply and transport of the medium P. The ejection controller 221 controls the carriage motor 150 so as to control a reciprocating operation of the carriage 131. In this embodiment, the ejection controller 221 executes a "normal print mode" for performing printing using all nozzle lines included in the liquid ejecting head 135 selected by the selection section 223 and a "nozzle restriction mode" for continuing printing only using a number of the nozzle lines selected by the selection section 223 from among the plurality of nozzle lines included in the liquid ejecting head 135 without interrupting a print process when ejection failure occurs in the nozzles Nz. The nozzle restriction mode will be described in detail hereinafter.

The detection section 222 detects ejection failure of the nozzles Nz. The detection section 222 ejects ink a plurality of times from the nozzles Nz so as to detect the nozzles Nz which do not eject ink droplets. The detection section 222 detects the nozzles Nz of ejection failure using a general ejection failure detection technique. For example, ink ejection states of the individual nozzles Nz may be detected by ejecting ink from the nozzles Nz and detecting changes of voltages between ejection surfaces of the ink where the nozzles Nz are opened and detection surfaces where the ink ejected from the nozzles Nz are detected while the voltages are applied between the ejection surfaces and the detection surfaces. Alternatively, the ink ejection states of the individual nozzles Nz may be detected by applying a driving signal to piezoelectric actuators corresponding to the nozzles Nz so that residual vibration after pressure is changed is detected, for example. Furthermore, a method for determining ejection failure of the nozzles Nz based on a captured image of a test pattern for a detection of nozzle ejection failure which is printed on the medium P, a method for determining ejection failure by measuring weights of ejected ink droplets, or a method for optically detecting ink droplets ejected from the nozzles Nz, for example, may be employed.

The selection section 223 selects use nozzle lines to be used in the nozzle restriction mode described above based on states of the ejection failure of the nozzles Nz in the individual nozzle lines. In this embodiment, the term "states of the ejection failure" indicates image quality contribution rates calculated using the numbers of nozzles Nz of the ejection failure in the individual nozzle lines and weight values 233 determined in advance in accordance with color density of the inks ejected from the individual nozzle lines and a setting value indicating presence or absence of ejection failure which is input by the user in the input reception section 224. A method for selecting use nozzle lines and the image quality contribution rates will be described in detail hereinafter.

The input reception section 224 receives a user input performed on the operation section 175. Examples of the user input include instructions associated with a general print process and instructions associated with settings of the nozzle restriction mode described below.

The memory 230 stores the control programs which realize the functions of the functional sections described above, an inspection program 231, nozzle check pattern data 232, and the weight values 233 in advance. The inspection program 231 is used to set the nozzle restriction mode described below and includes an inspection program used to detect ejection failure of the nozzles Nz included in the liquid ejecting head 135. The nozzle check pattern data 232 is image data of a nozzle check pattern CP described below. The nozzle check pattern CP is printed on the medium P and used to detect missing dots on the medium P.

The weight values 233 correspond to color density of the inks of cyan, magenta, yellow, and black. The weight values 233 are calculated in advance in experiment. Note that, instead of the color density of the ink, arbitrary parameters indicating visibility of the ink colors on the medium P may be used as the weight values 233.

Figure 3:
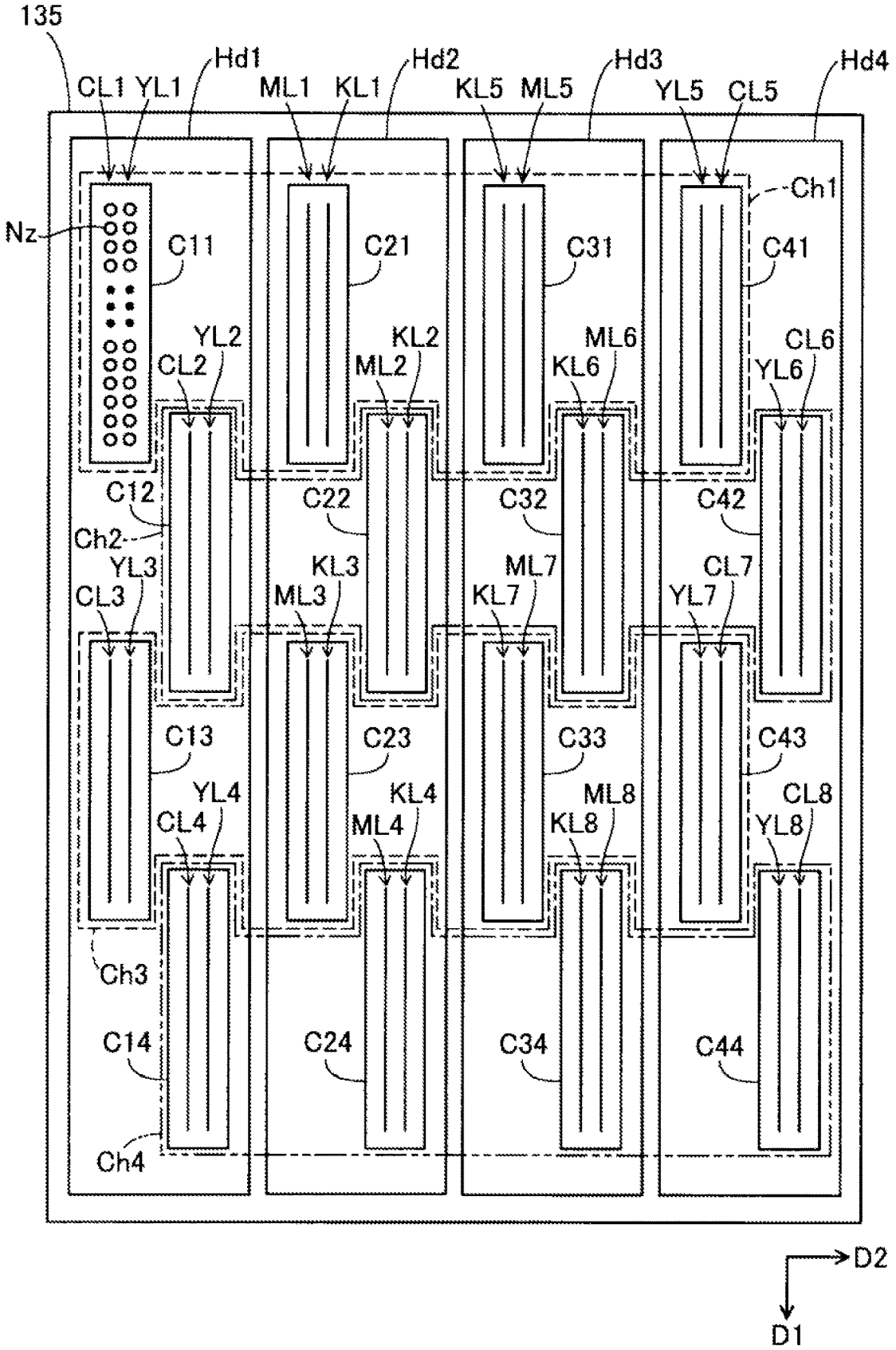
FIG. 3 is a diagram illustrating a configuration of a liquid ejecting head in detail.
Figure 4:
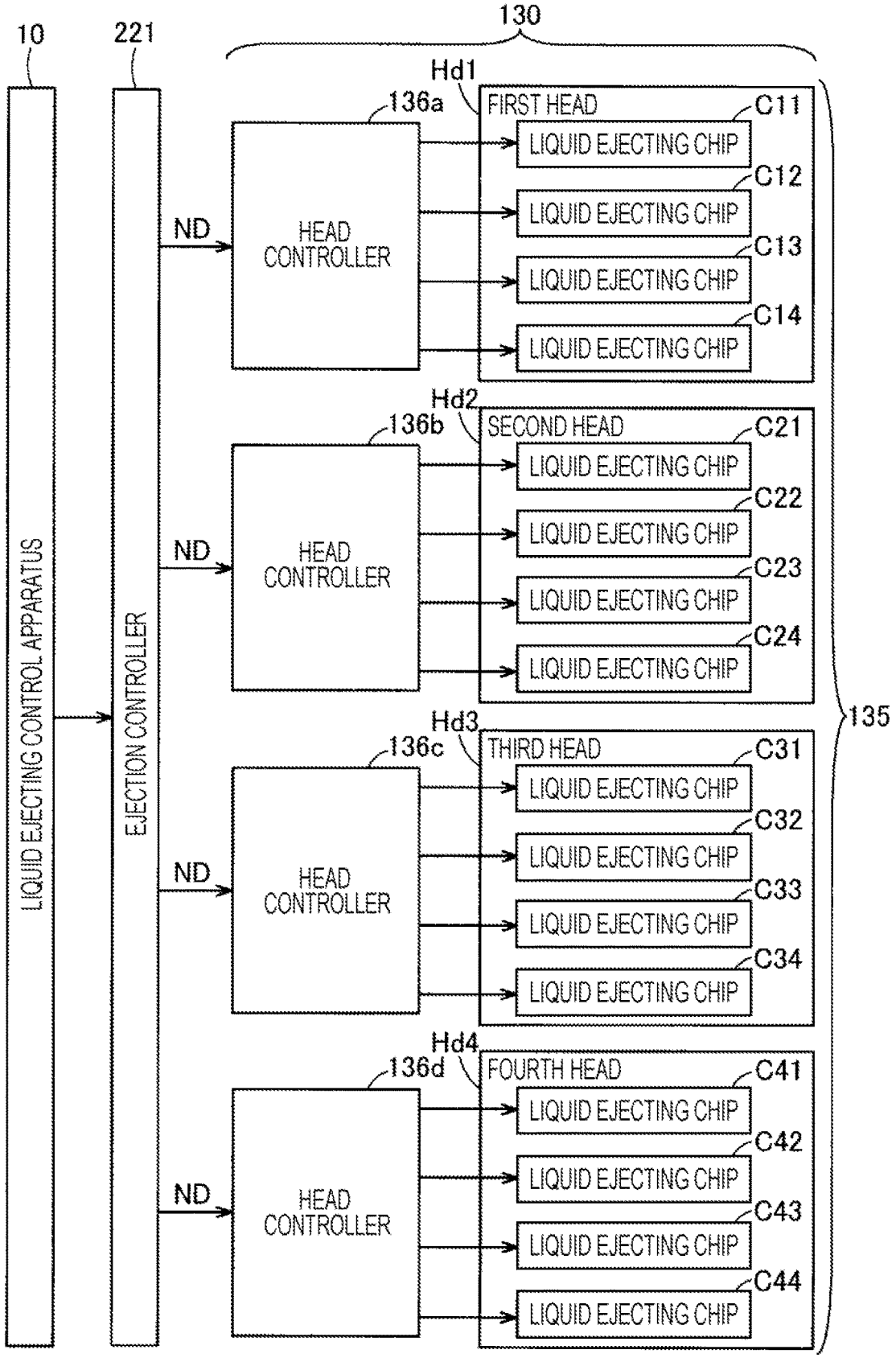
FIG. 4 is a block diagram illustrating an electric configuration of a liquid ejecting chip.

A configuration of the liquid ejecting head 135 and supply of a signal from the ejection controller 221 to the liquid ejecting head 135 will now be described with reference to FIGS. 3 and 4. FIG. 3 is a diagram illustrating a configuration of the liquid ejecting head 135 in detail. FIG. 4 is a diagram illustrating an electric configuration of the liquid ejecting head 135. In FIG. 3, a configuration of the liquid ejecting head 135 when viewed in a direction from the medium P to the ejection surface of ink in which the nozzles Nz are opened is illustrated. The liquid ejecting head 135 includes a first head Hd1, a second head Hd2, a third head Hd3, and a fourth head Hd4. Each of the heads Hd1 to Hd4 includes four liquid ejecting chips. The four liquid ejecting chips included in each of the heads Hd1 to Hd4 are arranged in a zigzag manner in the same positions in the individual heads Hd1 to Hd4.

Specifically, the four liquid ejecting chips included in one head are arranged such that two liquid ejecting chip lines, each of which includes two of the four liquid ejecting chips which are arranged with a certain gap in the sub-scanning direction D1, are arranged in the main scanning direction D2, and the two liquid ejecting chip lines are shifted from each other with a certain distance therebetween in the sub-scanning direction D1. Furthermore, each of the liquid ejecting chips has a region which overlaps, in the sub-scanning direction D1, with one of the other liquid ejecting chips which is positioned closest to the liquid ejecting chip in the sub-scanning direction D1.

The first head Hd1 includes a first liquid ejecting chip C11, a second liquid ejecting chip C12, a third liquid ejecting chip C13, and a fourth liquid ejecting chip C14. The second head Hd2 includes a fifth liquid ejecting chip C21, a sixth liquid ejecting chip C22, a seventh liquid ejecting chip C23, and an eighth liquid ejecting chip C24. The third head Hd3 includes a ninth liquid ejecting chip C31, a 10th liquid ejecting chip C32, an 11th liquid ejecting chip C33, and a 12th liquid ejecting chip C34. The fourth head Hd4 includes a 13th liquid ejecting chip C41, a 14th liquid ejecting chip C42, a 15th liquid ejecting chip C43, and a 16th liquid ejecting chip C44. Each of the liquid ejecting chips C11 to C44 is configured such that ink ejecting mechanisms, such as a piezoelectric actuator, an ink chamber, and the nozzles Nz, are fabricated as chips by applying a semiconductor processing technique.

The first liquid ejecting chip C11 has two nozzle lines of different colors of ink to be ejected. Specifically, the first liquid ejecting chip C11 includes a first nozzle line CL1 for ejecting a cyan ink and a second nozzle line YL1 for ejecting a yellow ink. Similarly, the second liquid ejecting chip C12 includes a third nozzle line CL2 for ejecting a cyan ink and a fourth nozzle line YL2 for ejecting a yellow ink. The third liquid ejecting chip C13 includes a fifth nozzle line CL3 for ejecting a cyan ink and a sixth nozzle line YL3 for ejecting a yellow ink. The fourth liquid ejecting chip C14 includes a seventh nozzle line CL4 for ejecting a cyan ink and an eighth nozzle line YL4 for ejecting a yellow ink.

The fifth liquid ejecting chip C21 includes a ninth nozzle line ML1 for ejecting a magenta ink and a 10th nozzle line KL1 for ejecting a black ink. Similarly, the sixth liquid ejecting chip C22 includes an 11th nozzle line ML2 for ejecting a magenta ink and a 12th nozzle line KL2 for ejecting a black ink. The seventh liquid ejecting chip C23 includes a 13th nozzle line ML3 for ejecting a magenta ink and a 14th nozzle line KL3 for ejecting a black ink. The eighth liquid ejecting chip C24 includes a 15th nozzle line ML4 for ejecting a magenta ink and an 16th nozzle line KL4 for ejecting a black ink.

The ninth liquid ejecting chip C31 includes a 17th nozzle line KL5 for ejecting a black ink and an 18th nozzle line ML5 for ejecting a magenta ink. Similarly, the 10th liquid ejecting chip C32 includes a 19th nozzle line KL6 for ejecting a black ink and a 20th nozzle line ML6 for ejecting a magenta ink. The 11th liquid ejecting chip C33 includes a 21st nozzle line KL7 for ejecting a black ink and a 22nd nozzle line ML7 for ejecting a magenta ink. The 12th liquid ejecting chip C34 includes a 23rd nozzle line KL8 for ejecting a black ink and an 24th nozzle line ML8 for ejecting a magenta ink.

The 13th liquid ejecting chip C41 includes a 25th nozzle line YL5 for ejecting a yellow ink and a 26th nozzle line CL5 for ejecting a cyan ink. Similarly, the 14th liquid ejecting chip C42 includes a 27th nozzle line YL6 for ejecting a yellow ink and a 28th nozzle line CL6 for ejecting a cyan ink. The 15th liquid ejecting chip C43 includes a 29th nozzle line YL7 for ejecting a yellow ink and a 30th nozzle line CL7 for ejecting a cyan ink. The 16th liquid ejecting chip C44 includes a 31st nozzle line YL8 for ejecting a yellow ink and a 32nd nozzle line CL8 for ejecting a cyan ink. Hereinafter, the nozzle lines CL1 to CL8, YL1 to YL8, ML1 to ML8, and KL1 to KL8 are collectively referred to as "nozzle lines NL" where appropriate.

As illustrated in the first liquid ejecting chip C11, each of the nozzle lines CL1 and the YL1 includes a plurality of nozzles Nz arranged in the sub-scanning direction D1 with a certain interval. Note that, although not illustrated in FIG. 3, also in the other liquid ejecting chips C12 to C44, each of the nozzle lines CL1 to CL8, YL1 to YL8, ML1 to ML8, and KL1 to KL8 similarly has a plurality of nozzles Nz. Each of the liquid ejecting chips C11 to C44 has a piezoelectric actuator and a liquid flow path structure, not illustrated, used to eject ink from the nozzles Nz. When the piezoelectric actuators are driven in response to input signals supplied from the ejection controller 221 to the liquid ejecting chips C11 to C44, the ink is ejected from the individual nozzles Nz. Note that, as a method for ejecting ink, instead of the piezoelectric actuator, various methods including a thermal method for ejecting ink from the nozzles Nz by bubbles generated in ink chambers using heating elements may be employed.

Next, a flow of a signal from the ejection controller 221 to the liquid ejecting head 135 will be described with reference to FIG. 4. The head unit 130 includes head controllers 136*a* to 136*d* corresponding to the respective head Hd1 to Hd4 in addition to the carriage 131 and the liquid ejecting head 135 illustrated in FIG. 1. In this embodiment, the ejection controller 221 generates print data PD corresponding to use nozzle lines selected by the selection section 223 using image data supplied from the liquid ejecting control apparatus 10 and divides the print data PD into a plurality of print image data ND corresponding to the head controllers 136*a* to 136*d* so as to transfer the print data PD to the head controllers 136*a* to 136*d*. Furthermore, the head controllers 136*a* to 136*d* transmit print control data based on the print image data ND to the individual liquid ejecting chips in the corresponding first to fourth head Hd1 to Hd4. The head controller 136*a* is connected to the corresponding liquid ejecting chips C11 to C14 and individually controls applying or non-applying of driving pulses to the piezoelectric actuators included in the corresponding liquid ejecting chips C11 to C14, that is, an On state or an Off state of dots, in accordance with the print control data supplied from the head controller 136*a*.

Similarly, the head controller 136*b* is connected to the liquid ejecting chips C21 to C24 and individually controls applying or non-applying of driving pluses to the piezoelectric actuators included in the liquid ejecting chips C21 to C24. The head controller 136*c* is connected to the liquid ejecting chips C31 to C34 and individually controls applying or non-applying of driving pluses to the piezoelectric actuators included in the liquid ejecting chips C31 to C34. The head controller 136*d* is connected to the liquid ejecting chips C41 to C44 and individually controls applying or non-applying of driving pluses to the piezoelectric actuators of the liquid ejecting chips C41 to C44. Note that driving waveforms including the driving pulses are generated by the ejection controller 221 or the head controllers 136*a* to 136*d* in response to an instruction issued by the controller 200 and transmitted to the liquid ejecting chips C11 to C44.

In this embodiment, when ink is ejected from the liquid ejecting chips of the liquid ejecting head 135 while the head unit 130 is moved in the main scanning direction D2 in the normal print mode in which all the nozzle lines of the liquid ejecting chips C11 to C44 are used, an image is printed in a region extending in the main scanning direction D2 with a width of the nozzle lines of the four liquid ejecting chips arranged in the sub-scanning direction D1 in the liquid ejecting head 135. Specifically, printing is performed on the region extending in the main scanning direction D2 with a width corresponding to the nozzle lines of the four liquid ejecting chips C11, C21, C31, and C41 (hereinafter referred to as a "first nozzle line group Ch1") arranged in a most upstream portion in the sub-scanning direction D1 of the head Hd1 to Hd4 using ink ejected from the first nozzle line group Ch1.

Furthermore, printing is performed on a region extending in the main scanning direction D2 with a width corresponding to the nozzle lines of the four liquid ejecting chips C12, C22, C32, and C42 (hereinafter referred to as a "second nozzle line group Ch2") arranged in a downstream portion relative to the first nozzle line group Ch1 in the sub-scanning direction D1 in the heads Hd1 to Hd4 using ink ejected from the second nozzle line group Ch2. Furthermore, printing is performed on a region extending in the main scanning direction D2 with a width corresponding to the nozzle lines of the four liquid ejecting chips C13, C23, C33, and C43 (hereinafter referred to as a "third nozzle line group Ch3") arranged in a downstream portion relative to the second nozzle line group Ch2 in the sub-scanning direction D1 in the heads Hd1 to Hd4 using ink ejected from the third nozzle line group Ch3. Moreover, printing is performed on a region extending in the main scanning direction D2 with a width corresponding to the nozzle lines of the liquid ejecting chips C14, C24, C34, and C44 (hereinafter referred to as a "fourth nozzle line group Ch4") arranged in a most downstream portion in the sub-scanning direction D1 of the head Hd1 to Hd4 using ink ejected from the fourth nozzle line group Ch4.

In the nozzle restriction mode described in detail below, use of the nozzle lines NL is restricted using each of the nozzle line groups Ch1 to Ch4 as a selection unit. By this, the number of use nozzle lines used in printing for one scanning on a region of a width corresponding to the nozzle lines NL in the normal print mode in which all the nozzle lines NL of all the liquid ejecting chips C11 to C44 are used and the number of use nozzle lines in printing for one scanning on the region of the width corresponding to the nozzle lines NL in the nozzle restriction mode become the same as each other so that a difference in print quality between color in the normal print mode and color in the nozzle restriction mode is suppressed. Specifically, in a case where ejection failure of a nozzle Nz in a certain nozzle line NL is detected and the nozzle line NL is set as a non-use nozzle line described below, all the nozzle lines NL arranged in one of the nozzle line groups Ch1 to Ch4 to which the nozzle line NL belongs are not used. The nozzle restriction mode will be described in detail hereinafter.

A2. Nozzle Restriction Mode Setting Process

Figure 5:
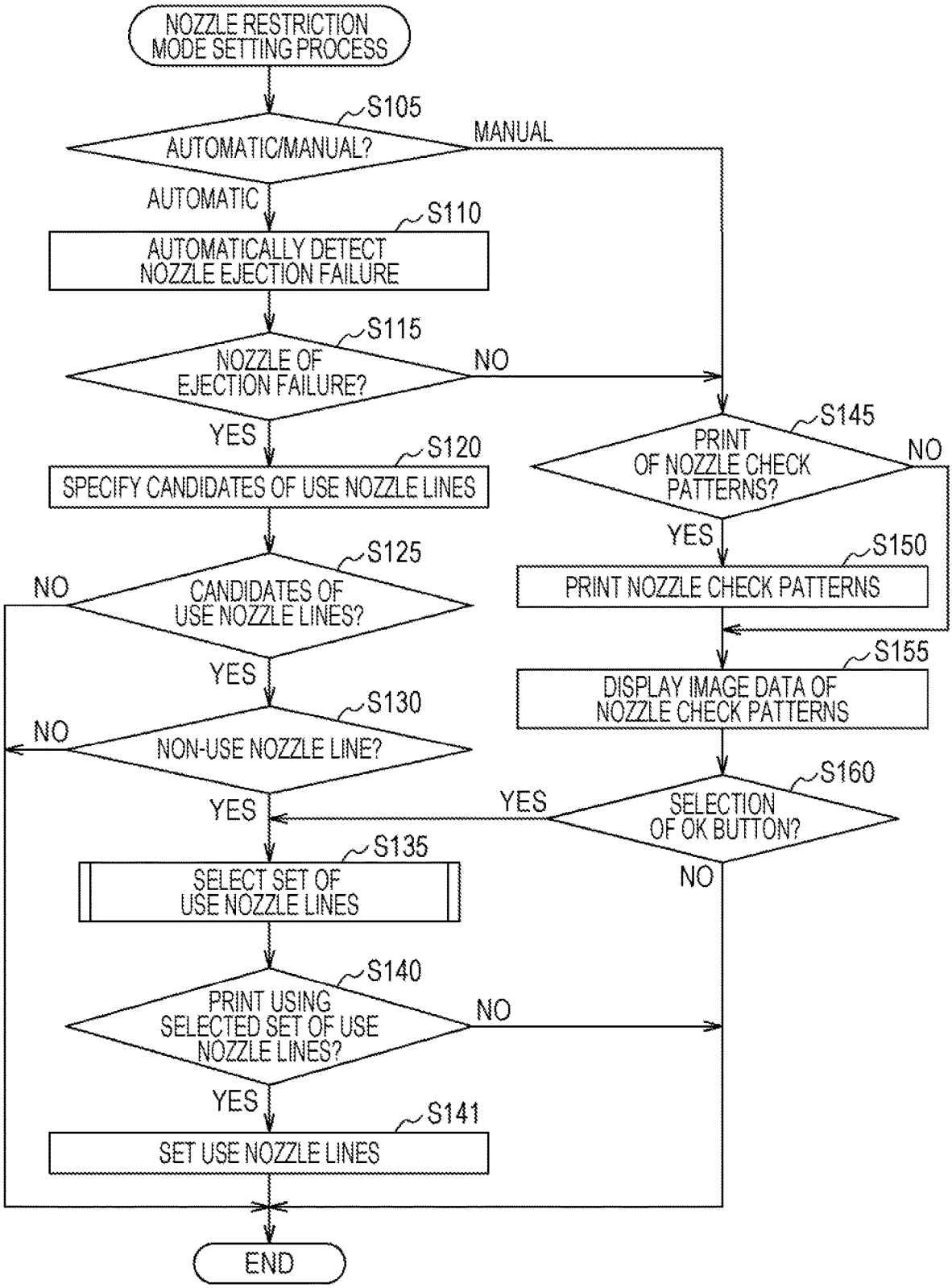
FIG. 5 is a flowchart of a processing procedure of a nozzle restriction mode setting process.

FIG. 5 is a flowchart of a processing procedure of the nozzle restriction mode setting process. The nozzle restriction mode setting process is started when a user of the liquid ejecting apparatus 100 selects execution of the nozzle restriction mode setting process of forming dots on the medium P only using a number of the nozzle line groups Ch1 to Ch4 included in the liquid ejecting head 135 in an operation menu indicating whether the nozzle restriction mode setting process of forming dots on the medium P only using a number of the nozzle line groups which is displayed in the display section 170 in a selectable manner is to be executed.

In step S105, the controller 200 determines whether ejection failure of the nozzles Nz is to be automatically or manually detected. Specifically, first, the display section 170 displays automatic execution and manual execution in a selectable manner as a method for executing detection of ejection failure of the nozzles Nz. Subsequently, the input reception section 224 receives an input of the selection performed by the user through the operation section 175. Thereafter, the controller 200 determines whether the received input indicates the automatic execution or the manual execution.

When it is determined that the automatic execution is received in step S105 (step S105: Automatic), the detection section 222 automatically detects ejection failure of the nozzles Nz in step S110. Specifically, the detection section 222 determines whether ejection failure, such as missing dots of the nozzle lines NL, has occurred using the general ejection failure detection technique described above. The detection section 222 obtains the numbers of nozzles Nz of the ejection failure of individual nozzle lines NL as a result of the detection.

The detection section 222 determines whether at least one of the nozzles Nz is ejection failure in step S115. Specifically, the detection section 222 determines whether the number of nozzles Nz of the ejection failure obtained in step S110 described above is zero. When it is determined whether at least one of the nozzles Nz is ejection failure (step S115: YES), the selection section 223 specifies use nozzle line candidates and non-use nozzle lines based on states of the ejection failure of the nozzles Nz in the individual nozzle lines NL in step S120. In this embodiment, the term "non-use nozzle line" means a nozzle line which is not used for forming dots in the nozzle restriction mode. The use nozzle line candidates and the non-use nozzle lines are specified in the following procedure.

Specifically, first, the selection section 223 calculates image quality contribution rates of the individual nozzle lines NL using the numbers of nozzles of ejection failure of the nozzle lines NL detected by the detection section 222 and the weight values 233 of the individual ink colors described above stored in the memory 230. The image quality contribution rates are calculated in accordance with Expression (1) below.

$$\text{(Image Quality Contribution Rate)}=\text{(The Number of Nozzles of Ejection Failure)}\times\text{(Weight Value 233)} \quad \text{Expression (1)}$$

Subsequently, the selection section 223 calculates a sum of the image contribution rates of each of the nozzle line groups Ch1 to Ch4 to which the nozzle lines NL belong. Specifically, a sum of image quality contribution rates of the nozzle lines CL1, YL1, ML1, KL1, KL5, ML5, YL5, and CL5 which belong to the nozzle line group Ch1 is obtained. Similarly, a sum of image quality contribution rates of the nozzle lines CL2, YL2, ML2, KL2, KL6, ML6, YL6, and CL6 which belong to the nozzle line group Ch2, a sum of image quality contribution rates of the nozzle lines CL3, YL3, ML3, KL3, KL7, ML7, YL7, and CL7 which belong to the nozzle line group Ch3, and a sum of image quality contribution rates of the nozzle lines CL4, YL4, ML4, KL4, KL8, ML8, YL8, and CL8 which belong to the nozzle line group Ch4 are individually obtained.

Thereafter, the selection section 223 compares the image quality contribution rates of the individual nozzle line groups Ch1 to Ch4 with a predetermined threshold value and determines that a number of the nozzle line groups Ch1 to Ch4 having the image quality contribution rates which are smaller than the predetermined threshold value are use nozzle line candidates and the others of the nozzle line groups Ch1 to Ch4 having the image quality contribution rates which are equal to or larger than the predetermined threshold value are non-use nozzle line.

Next, in step S125, the controller 200 determines whether at least one of the nozzle line groups Ch1 to Ch4 has been set as a use nozzle line candidate. When the determination is affirmative, (step S125: YES), the controller 200 proceeds to step S130. In step S130, the controller 200 determines whether at least one of the nozzle line groups Ch1 to Ch4 is a non-use nozzle line. When the determination is affirmative (step S130: YES), the controller 200 proceeds to step S135.

On the other hand, when the determination is negative in step S125 above (step S125: NO), the nozzle restriction mode setting process is terminated and information indicating that ejection failure has occurred in all the nozzle line groups is additionally displayed in the menu screen of the various functions of the liquid ejecting apparatus 100.

Furthermore, when the determination is negative in step S130 (step S130: NO), the nozzle restriction mode setting process is terminated and information indicating that all the nozzle line groups are available for printing is additionally displayed in the menu screen of the various functions of the liquid ejecting apparatus 100.

In step S135, the selection section 223 selects a set of use nozzle lines to be used for printing in the nozzle restriction mode from among the use nozzle line candidates described above. A method for selecting a set of use nozzle lines will be described in detail hereinafter with reference to FIG. 7.

In step S140, the controller 200 determines whether the nozzle restriction mode is to be executed using the set of the use nozzle lines selected by the selection section 223. Specifically, the display section 170 displays the set of the use nozzle lines to be used in the nozzle restriction mode selected by the selection section 223 from among the nozzle line groups Ch1 to Ch4 and displays a determination as to whether printing is to be executed in the nozzle restriction mode using the use nozzle lines of interest. The input reception section 224 receives an input of a selection of the user through the operation section 175. Then the controller 200 determines whether the received input indicates execution of printing in the nozzle restriction mode using the use nozzle lines set by the selection section 223.

In a case where it is determined that the nozzle restriction mode is to be executed using the use nozzle lines selected by the selection section 223 in step S140 (step S140: YES), the set of the selected use nozzle lines is set as use nozzle lines in the nozzle restriction mode in step S141, and information indicating that the nozzle restriction mode in which ink is ejected using the use nozzle lines selected from among all the nozzle lines NL is displayed in the menu screen of the various functions of the liquid ejecting apparatus 100. Thereafter, when the liquid ejecting apparatus 100 executes printing, the ejection controller 221 divides image data PD generated in accordance with the use nozzle lines set by the selection section 223 into a plurality of print image data ND corresponding to the head controllers 136*a* to 136*d*, and the head controllers 136*a* to 136*d* transmit print control data based on the print image data ND to the individual liquid ejecting chips included in the corresponding first to fourth heads Hd1 to Hd4 so that printing is started in the nozzle restriction mode.

On the other hand, when the determination is negative in step S140 (step S140: No), the nozzle restriction mode setting process is terminated and the menu screen of the various functions of the liquid ejecting apparatus 100 is displayed in the display section 170.

When it is determined that the manual execution is performed in step S105 (step S105: Manual) or when it is determined that ejection failure has not occurred in the nozzles Nz in step S115 (step S115: NO), the ejection controller 221 determines whether the nozzle check patterns CP are to be printed in step S145. Specifically, first, the display section 170 displays a selection whether the nozzle check patterns are to be printed in an operation screen of the nozzle restriction mode setting process. Subsequently, the input reception section 224 receives an input of the selection performed by the user through the operation section 175. Then the ejection controller 221 determines whether the received input indicates that the nozzle check patterns CP are to be printed or not to be printed. For example, in a case where the nozzle check patterns CP have been printed and the user has recognized an ejection failure state of the nozzles Nz when failure occurs in the normal print mode using all the nozzle lines, for example, printing of the nozzle check patterns CP may not be required.

The process in step S145 is also executed when it is determined that ejection failure has not occurred in the nozzles Nz in the automatic detection of the ejection failure of the nozzle Nz in step S115 above (step S115: NO) since the user may desire to visually check the nozzle check patterns CP printed on the medium P so as to detect ejection failure of the nozzles Nz.

When it is determined that the nozzle check patterns CP are to be printed in step S145 above (step S145: YES), the ejection controller 221 prints the nozzle check patterns CP in step S150. After the process in step S150 is performed or when it is determined that the nozzle check patterns CP are not to be printed in step S145 above (step S145: NO), the display section 170 displays image data representing the nozzle check patterns CP in step S155. By this, the user may select a nozzle line of the nozzles Nz of the ejection failure on the nozzle check patterns CP displayed in the display section 170.

Figure 6:
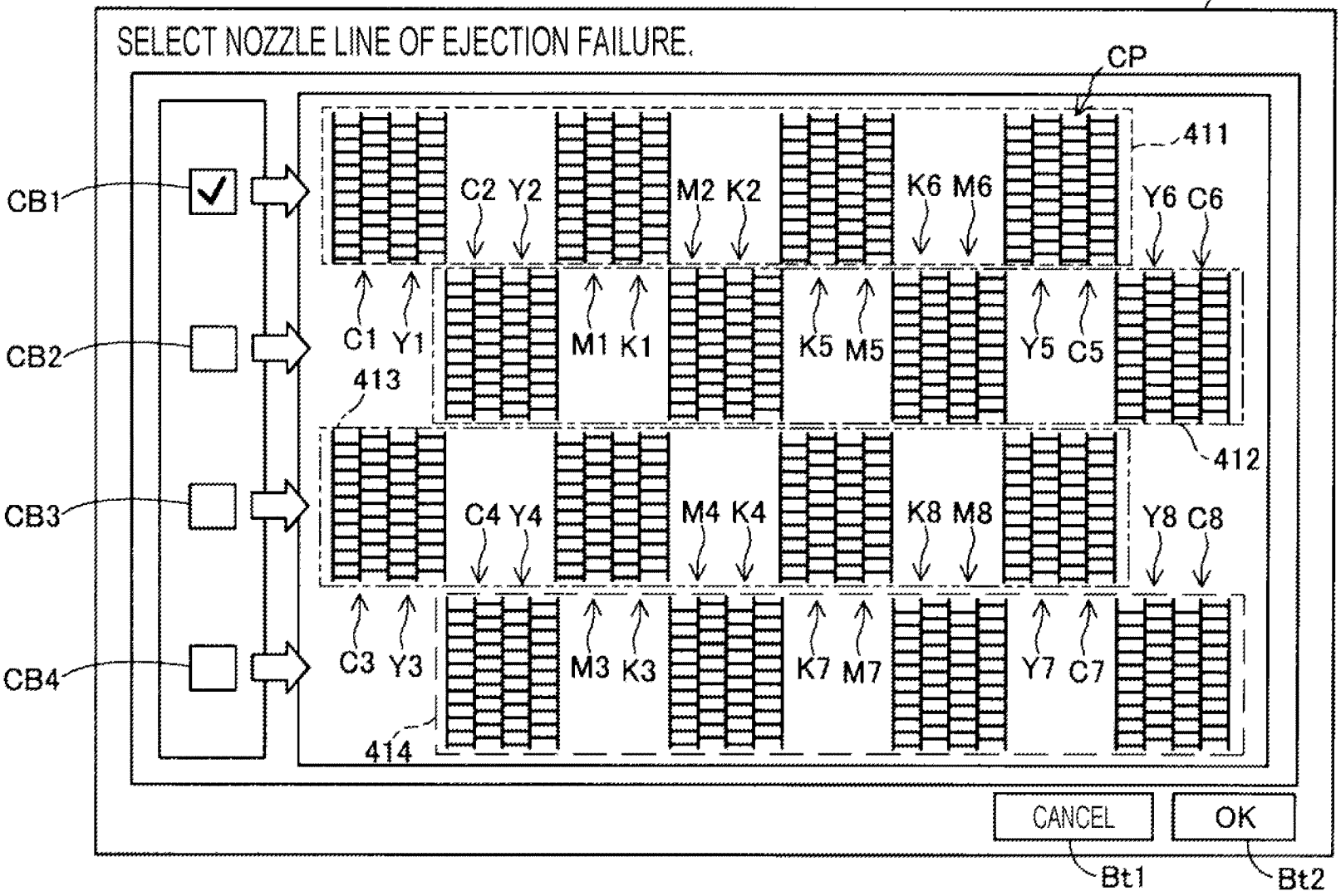
FIG. 6 is a diagram schematically illustrating an example of a display screen displayed in step S155.

FIG. 6 is a diagram schematically illustrating an example of a display screen SC1 displayed in step S155. Image data which represents a plurality of nozzle check patterns CP indicating the nozzle line groups Ch1 to Ch4, check boxes CB1 to CB4 corresponding to the nozzle line groups Ch1 to Ch4, a cancel button Bt1, and an OK button Bt2 are displayed in the display screen SC1. Any pattern may be employed as the nozzle check patterns CP to be printed on the medium P as long as presence or absence of ejection failure of the nozzles Nz may be recognized. In this embodiment, the nozzle check patterns CP are printed by forming a predetermined number of dots by simultaneously ejecting liquid from the nozzles Nz disposed every predetermined number of nozzles Nz in the individual nozzle lines NL while the liquid ejecting head 135 is moved for scanning in the main scanning direction D2 so that dots of the adjacent nozzles Nz may be distinguished, and consequently, liquid is ejected from all the nozzles Nz to the medium P while the nozzles Nz of ejection are changed in turn.

The image data indicating the nozzle line groups Ch1 to Ch4 displayed in the display screen SC1 is displayed such that the user may easily check one of the check boxes CB1 to CB4 corresponding to one of the nozzle line groups to which a nozzle Nz or a nozzle line NL determined as ejection failure with reference to the nozzle check patterns CP printed on the medium P belongs. In this embodiment, image data displayed in the display screen SC1 is configured by ruled lines which are rendered with a certain interval in the main scanning direction D2 and the sub-scanning direction D1 and which represent the nozzle check patterns CP.

The individual nozzle check patterns CP correspond to the liquid ejecting chips C11 to C14 illustrated in FIG. 3. For example, the nozzle check patterns CP in an uppermost row of FIG. 6 correspond to the liquid ejecting chips C11 to C14 from the left and correspond to the nozzle lines CL1, YL1, ML1, KL1, KL5, ML5, YL5, and CL5 of the liquid ejecting chips C11 to C14. Specifically, a region 411 which displays the four nozzle check patterns CP in the uppermost row corresponds to the first nozzle line group Ch1.

Similarly, in regions 412, 413, and 414 positioned on a downstream side relative to the region 411 in the sub-scanning direction D1, the four nozzle check patterns CP in the region 412 corresponds to the nozzle lines NL which belong to the second nozzle line group Ch2, the four nozzle check patterns CP in the region 413 correspond to the nozzle lines NL which belong to the third nozzle line group Ch3, and the four nozzle check patterns CP in the region 414 correspond to the nozzle lines NL which belong to the fourth nozzle line group Ch4.

In FIG. 6, in each of the nozzle check patterns CP, nozzle check patterns corresponding to the nozzle lines CL1 to CL8 which eject ink of cyan are denoted by reference symbols C1 to C8, respectively, for convenience of drawing. Similarly, nozzle check patterns CP corresponding to the nozzle lines YL1 to YL8 which eject ink of yellow are denoted by reference symbols Y1 to Y8, respectively, nozzle check patterns CP corresponding to the nozzle lines ML1 to ML8 which eject ink of magenta are denoted by reference symbols M1 to M8, respectively, and nozzle check patterns CP corresponding to the nozzle lines KL1 to KL8 which eject ink of black are denoted by reference symbols K1 to K8, respectively.

As is apparent from a comparison between FIGS. 3 and 6, an arrangement positions of the nozzle check patterns CP of FIG. 6 are the same as those of the nozzle lines NL in the liquid ejecting head 135 of FIG. 3. However, the individual nozzle check patterns CP do not overlap with one another in the sub-scanning direction D1. In this way, since the individual nozzle check patterns CP are displayed in the arrangement positions which are the same as those of the nozzle lines NL in the liquid ejecting head 135 but do not overlap with one another in the sub-scanning direction D1, the user may easily select the nozzle lines NL and the liquid ejecting chips C11 to C44 of ejection failure.

The check boxes CB1 to CB4 are used by the user to select a nozzle line NL of ejection failure, or more specifically, one of the nozzle line groups Ch1 to Ch4 to which a nozzle line NL of ejection failure belongs. The check box CB1 corresponds to the first nozzle line group Ch1. Similarly, the check box CB2 corresponds to the second nozzle line group Ch2, the check box CB3 corresponds to the third nozzle line group Ch3, and the check box CB4 corresponds to the fourth nozzle line group Ch4.

The user checks one of the check boxes CB1 to CB4 corresponding to a nozzle line group to which a nozzle Nz or a nozzle line NL of ejection failure belongs and selects the OK button Bt2 or the cancel button Bt1. One of the nozzle line groups Ch1 to Ch4 corresponding to one of the check boxes CB1 to CB4 which is checked is set as a non-use nozzle line of ejection failure. On the other hand, the others of the nozzle line groups Ch1 to Ch4 corresponding to the others of the check boxes CB1 to CB4 which are not checked are set as use nozzle line candidates which do not include a nozzle line of ejection failure.

In a case where the user checks all the check boxes CB1 to CB4, information indicating that at least one of the check boxes CB1 to CB4 is required to be unchecked or the cancel button Bt1 is required to be selected may be displayed in the display section 170. Note that the user may check at least one of the check boxes CB1 to CB4 corresponding to the nozzle line groups Ch1 to Ch4 in which ejection failure has not occurred. In this case, at least one of the nozzle line groups Ch1 to Ch4 corresponding to at least one of the check boxes CB1 to CB4 which has been checked is set as a use nozzle line candidate and the others of the nozzle line groups Ch1 to Ch4 corresponding to the others of the check boxes CB1 to CB4 which have not been checked are set as non-use nozzle lines. Specifically, at least presence or absence of ejection failure of the nozzle line groups Ch1 to Ch4 may be selected by checking the check boxes CB1 to CB4 by the user.

Referring back to FIG. 5, in step S160, the controller 200 determines whether the user has selected the OK button Bt2.

When the determination is affirmative (step S160: YES), the input reception section 224 receives a selection of presence or absence of ejection failure of the nozzle line groups Ch1 to Ch4 using setting values set in the check boxes CB1 to CB4 and the process in step S135 above is executed. On the other hand, when the determination is negative in step S160 (step S160: NO), an input of selection of a nozzle line of ejection failure is not performed, the nozzle restriction mode setting process is terminated, and the menu screen of the various functions of the liquid ejecting apparatus 100 is displayed in the display section 170.

A3. Method for Selecting Use Nozzle Lines

FIG. 7 is a diagram illustrating examples of sets of use nozzle lines. A column A of FIG. 7 represents a set of use nozzle lines in the normal print mode in which all the nozzle lines NL of the four nozzle line groups Ch1 to Ch4 are set as use nozzle lines. Columns B to J represent sets of use nozzle lines in the nozzle restriction mode set such that a plurality of nozzle line groups which are adjacent to each other in the sub-scanning direction D1 or one of the four nozzle line groups Ch1 to Ch4 is set as a set of use nozzle lines.

The sets of use nozzle lines in the columns B and C are obtained when three of the nozzle line groups Ch1 to Ch4 which are adjacent to each other in the sub-scanning direction D1 serve as use nozzle lines. The column B represents a case where the three nozzle line groups Ch2 to Ch4 which are consecutively adjacent to each other in the sub-scanning direction D1 serve as use nozzle lines and the nozzle line group Ch1 serves as a non-use nozzle line. The column C represents a case where the three nozzle line groups Ch1 to Ch3 which are consecutively adjacent to each other in the sub-scanning direction D1 serve as use nozzle lines and the nozzle line group Ch4 serves as a non-use nozzle line.

The sets of use nozzle lines in the columns D to F are obtained when two of the four nozzle line groups Ch1 to Ch4 which are consecutively adjacent to each other in the sub-scanning direction D1 serve as use nozzle lines. The column D represents a case where the two nozzle line groups Ch3 and Ch4 which are consecutively adjacent to each other in the sub-scanning direction D1 serve as use nozzle lines. The column E represents a case where the two nozzle line groups Ch2 and Ch3 which are consecutively adjacent to each other in the sub-scanning direction D1 serve as use nozzle lines. The column F represents a case where the two nozzle line groups Ch1 and Ch2 which are consecutively adjacent to each other in the sub-scanning direction D1 serve as use nozzle lines.

The sets of use nozzle lines in the columns G to J are obtained when one of the four nozzle line groups Ch1 to Ch4 serves as a use nozzle line. Here, a set of use nozzle lines includes, in addition to a case where a plurality of nozzle line groups serve as use nozzle lines, a case where only one nozzle line group serves as a use nozzle line.

Next, the process performed in step S135 above in the nozzle restriction mode setting process will be described. First, the selection section 223 selects a set of nozzle line groups which are adjacent to each other in the sub-scanning direction D1 from among the nozzle line groups Ch1 to Ch4 or one of the nozzle line groups Ch1 to Ch4 as use nozzle line set candidates or a use nozzle line candidate. Here, the set of nozzle line groups which are adjacent to each other in the sub-scanning direction D1 is selected due to the following reason.

Specifically, in a case where dots are formed using nozzle line groups which are not consecutively adjacent to each other in the sub-scanning direction D1, in printing in which a movement of the head unit 130 in the main scanning direction D2 and transport of the medium P in the sub-scanning direction D1 are repeatedly performed, control for transport of the medium P performed to print an image obtained by appropriately combining dots formed on the medium P by ink ejected from the individual nozzle line groups is complicated. Furthermore, a period of time from when ink ejected from a certain nozzle line group impacts on a certain region in the medium P and the medium P is transported to when ink ejected from another nozzle line group impacts on the certain region or a region adjacent to the certain region in next main scanning is different from a case of the normal print mode, and therefore, image quality is deteriorated. Therefore, in this embodiment, occurrence of the problem described above is suppressed by selecting nozzle line groups which are consecutively adjacent to each other in the sub-scanning direction D1 as a set of use nozzle lines.

Subsequently, the selection section 223 selects a set of use nozzle lines to be used in the nozzle restriction mode from among the use nozzle line set candidates. When a plurality of candidates of use nozzle lines have been selected, the selection section 223 preferentially selects a set of use nozzle lines having a larger number of nozzle line groups so that a print state which is more similar to the normal print mode is attained as illustrated in FIG. 7. Furthermore, the selection section 223 selects a set of use nozzle lines after setting a selection condition when a plurality of candidates of a set of use nozzle lines which have the same number of nozzle line groups exist. In this embodiment, a nozzle line group arranged on an upper stream side in the sub-scanning direction D1 is preferentially selected as a set of use nozzle lines.

For example, in a case where a state of ejection failure is specified such that, in the four nozzle line groups Ch1 to Ch4, the nozzle line group Ch2 is an non-use nozzle line and the nozzle line groups Ch1, Ch3, and Ch4 are use nozzle line candidates in step S120 or step S160, the selection section 223 selects a set of the nozzle line groups Ch3 and Ch4 in the column D, a set only including the nozzle line group Ch4 in the column G, a set only including the nozzle line group Ch3 in the column H, and a set only including the nozzle line group Ch1 in the column J as candidates of a set of use nozzle lines. Subsequently, the selection section 223 selects the set of the nozzle line groups Ch3 and Ch4 in the column D having a largest number of nozzle line groups in the candidates of a set of use nozzle lines described above as a set of use nozzle lines to be used in the nozzle restriction mode.

Furthermore, in a case where a state of ejection failure is specified such that, in the four nozzle line groups Ch1 to Ch4, the nozzle line groups Ch2 and Ch3 are non-use nozzle lines and the nozzle line groups Ch1 and Ch4 are use nozzle line candidates in step S120 or step S160, the selection section 223 selects a set of only the nozzle line group Ch4 in the column G and a set of only the nozzle line group Ch1 in the column J as candidates of a set of use nozzle lines. Thereafter, although the selection section 223 preferentially selects a set of use nozzle lines having a larger number of nozzle line groups, since the set of only the nozzle line group Ch4 in the column G and the set of only the nozzle line group Ch1 in the column J have the same number of nozzle line groups in this example, the set of only the nozzle line group Ch4 in the column G arranged on an upper stream side in the sub-scanning direction D1 is selected as a set of use nozzle lines to be used in the nozzle restriction mode.

The liquid ejecting apparatus 100 of the first embodiment described above includes the liquid ejecting head 135 having the four nozzle line groups Ch1 to Ch4 which have the nozzle lines NL and which are arranged in the sub-scanning direction D1, the selection section 223 which selects a set of use nozzle lines to be used for forming dots on the medium P from among the nozzle line groups Ch1 to Ch4, and the ejection controller 221 which forms dots by ejecting liquid from the individual nozzles Nz of the selected set of the use nozzle lines. Here, the selection section 223 selects a plurality of nozzle line groups which are consecutively adjacent to each other in the sub-scanning direction D1 from among the nozzle line groups Ch1 to Ch4 as a set of use nozzle lines to be used in the nozzle restriction mode. Accordingly, when ejection failure of the nozzles Nz is detected, printing may be continued by the liquid ejecting apparatus 100 without stopping printing although the printing is performed only using the selected set of use nozzle line groups, and therefore, deterioration of productivity of a printed matter may be suppressed.

Furthermore, since nozzle line groups which are consecutively adjacent to each other in the sub-scanning direction D1 are selected as a set of use nozzle lines, an image may be formed by dots on the medium P without performing complicated transport control while deterioration of image quality may be suppressed when compared with a configuration in which nozzle line groups which are not consecutively arranged in the sub-scanning direction D1 are selected as a set of use nozzle lines.

In addition, when a plurality of candidates of a set of use nozzle lines exist, the selection section 223 preferentially selects a candidate of a set of use nozzle lines having a largest number of nozzle line groups from among the candidates of a set of use nozzle lines, and therefore, dots may be formed using a larger number of nozzle line groups when ejection failure of a nozzle Nz is detected.

Furthermore, the liquid ejecting apparatus 100 further includes the detection section 222 which detects ejection failure of the individual nozzles Nz, and each of the nozzle line groups Ch1 to Ch4 includes eight nozzle lines NL arranged in the main scanning direction D2. Each of the nozzle line groups Ch1 to Ch4 has two nozzle lines NL for ejecting a cyan ink, two nozzle lines NL for ejecting a magenta ink, two nozzle lines NL for ejecting a yellow ink, and two nozzle lines NL for ejecting a black ink, and the selection section 223 selects a set of use nozzle lines based on a state of ejection failure indicated by image quality contribution rate values calculated using the numbers of nozzles of ejection failure in the nozzle lines and the weight values 233 corresponding to density of colors of ink ejected from the individual nozzle lines NL, and therefore, a set of use nozzle lines may be appropriately selected in accordance with visibility of ink on the medium P.

The liquid ejecting apparatus 100 further includes the display section 170 displaying image data indicating the nozzle line groups Ch1 to Ch4 and the input reception section 224 which receives a selection of presence or absence of ejection failure in the nozzle line groups Ch1 to Ch4. The selection section 223 selects use nozzle lines based on the presence or absence of ejection failure in the nozzle line groups Ch1 to Ch4 received by the input reception section 224, and therefore, the selection section 223 may select a set of nozzle line groups which are consecutively adjacent to each other in the sub-scanning direction D1 when the user only performs an input in accordance with a state of presence or absence of ejection failure of the individual nozzle line groups. Accordingly, usability may be improved.

B. Second Embodiment

Figure 8:
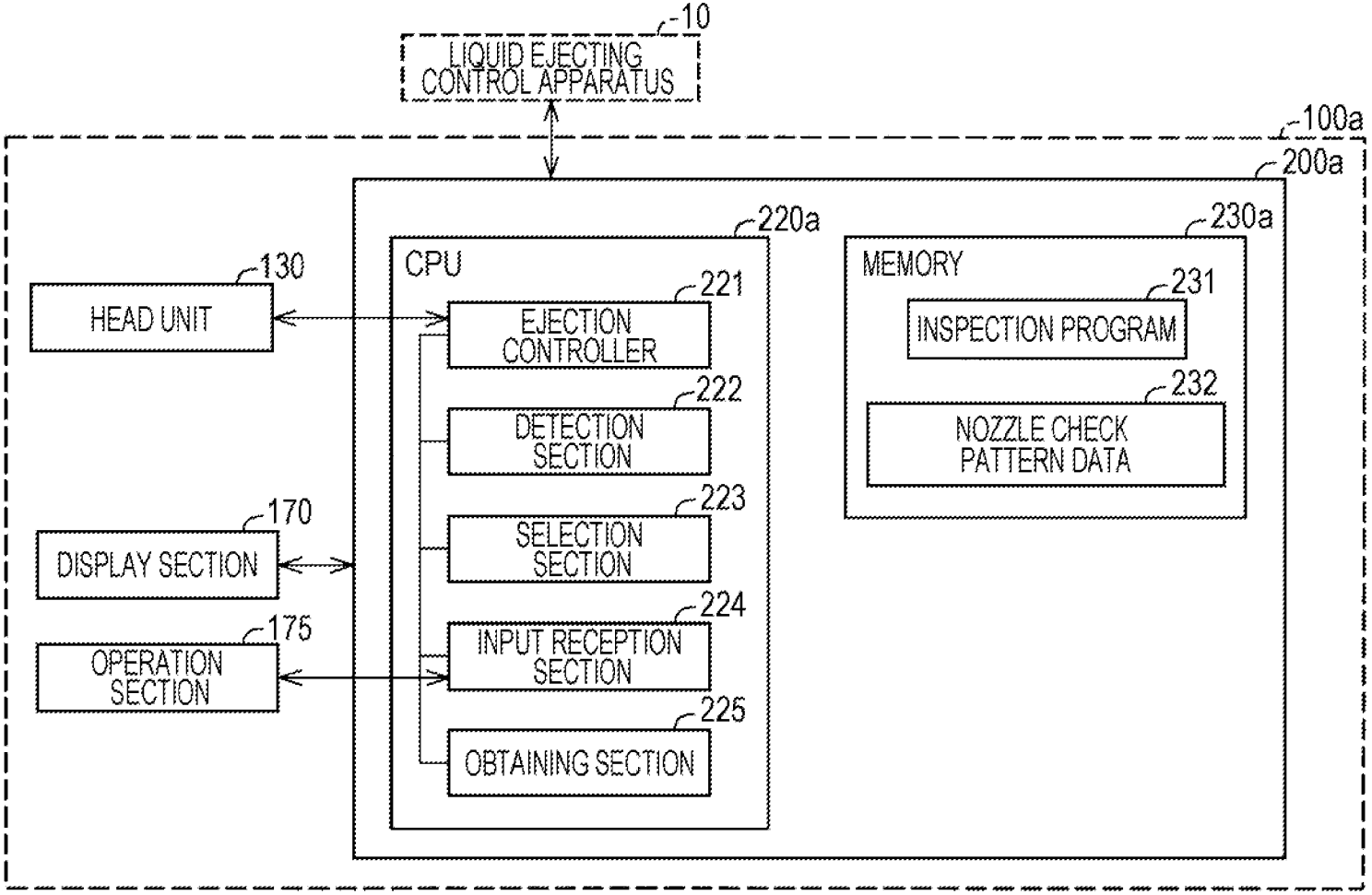
FIG. 8 is a block diagram illustrating a configuration of a liquid ejecting apparatus according to a second embodiment.

FIG. 8 is a block diagram illustrating a configuration of a liquid ejecting apparatus 100*a* according to a second embodiment.

The liquid ejecting apparatus 100*a* of the second embodiment is different from the liquid ejecting apparatus 100 of the first embodiment in that the liquid ejecting apparatus 100*a* includes a controller 200*a* instead of the controller 200. Other configurations of the liquid ejecting apparatus 100*a* are the same as those of the first embodiment, and therefore, detailed descriptions thereof are omitted.

The controller 200*a* is different from the controller 200 of the first embodiment in that the controller 200*a* includes a CPU 220*a* and a memory 230*a* instead of the CPU 220 and the memory 230. The CPU 220*a* is different from the CPU 220 in that the CPU 220*a* additionally includes an obtaining section 225, and the memory 230*a* is different from the memory 230 in that the weight values 233 are omitted. Other configurations of the controller 200*a* are the same as those of the first embodiment, and therefore, detailed descriptions thereof are omitted.

The obtaining section 225 obtains a dot formation rate which is a rate of dots formed by ink ejected from each of nozzle lines to all dots forming an image to be printed from print data PD. The dot formation rate is a weight value to be used when an image quality contribution rate is calculated. The dot formation rate is obtained by calculating a rate of dots formed by nozzles Nz of each of the nozzle lines to all the dots which form an image on the medium P using the print data PD. The obtained dot formation rates are used as states of ejection failure of the nozzles Nz in a nozzle restriction mode setting process.

The memory 230*a* does not include the weight values 233. This is because the dot formation rates obtained using the print data PD through the obtaining section 225 are used as weight values in calculation of the image quality contribution rates indicating states of ejection failure of the nozzles Nz. Note that the weight values 233 may be stored in the memory 230*a* and the weight values 233 corresponding to visibility of liquid on the medium P may be used as described in the first embodiment, in addition to the dot formation rates, as the states of the ejection failure of the nozzles Nz.

Figure 9:
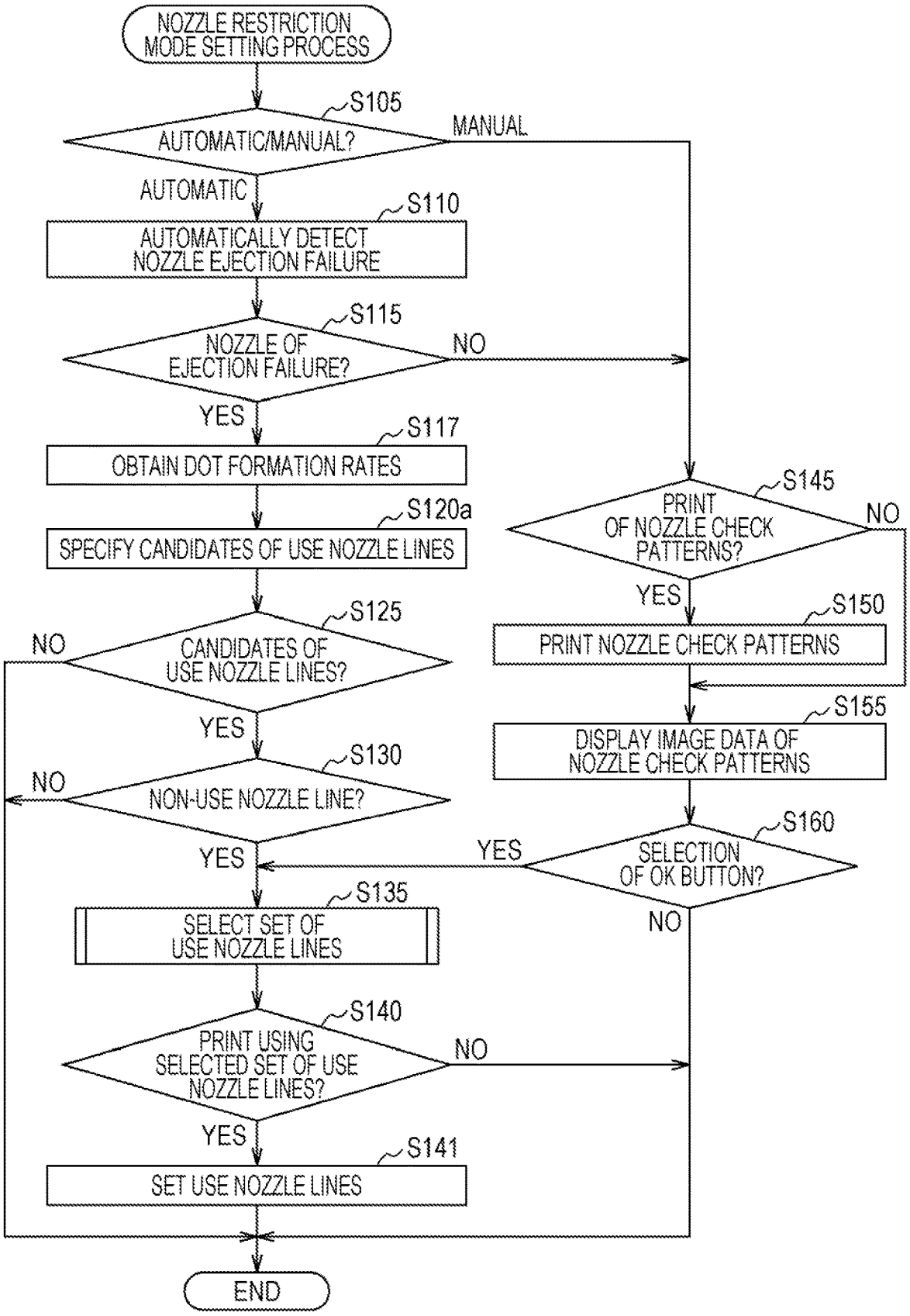
FIG. 9 is a flowchart of a processing procedure of a nozzle restriction mode setting process according to the second embodiment.

FIG. 9 is a flowchart of a processing procedure of a nozzle restriction mode setting process according to the second embodiment. The nozzle restriction mode setting process of the second embodiment is different from that in the first embodiment illustrated in FIG. 5 in that a process in step S117 and a process in step S120*a* are executed instead of the process in step S120. The other steps of the nozzle restriction mode setting process of the second embodiment are the same as those of the nozzle restriction mode setting process of the first embodiment, and therefore, the same reference numerals are assigned to the same steps and detailed descriptions thereof are omitted.

As illustrated in FIG. 9, when it is determined that ejection failure has occurred in at least one of the nozzles Nz in step S115 (step S115: YES), the obtaining section 225 obtains dot formation rates in step S117 and the selection section 223 specifies use nozzle line candidates and non-use nozzle lines based on states of the ejection failure of the nozzles Nz in the individual nozzle lines NL in step S120*a*.

Specifically, the obtaining section 225 obtains dot formation rates in step S117. In this embodiment, rates of dots of individual inks, that is, a cyan ink, a magenta ink, a yellow ink, and a black ink, included in all dots formed for print of a target image are obtained as the dot formation rates of the nozzle lines which eject the inks of the respective colors. In step S120*a*, the selection section 223 calculates image quality contribution rates of the individual nozzle lines NL similarly to step S120 of the first embodiment. In the second embodiment, the image quality contribution rates of the individual nozzle lines NL are obtained in accordance with Expression (2) below using the obtained dot formation rates as weight values.

(Image Quality Contribution Rate)=(The Number of Nozzles *Nz* of Ejection Failure)×(Dot Formation Rate) Expression (2)

A number of the nozzle lines NL may be appropriately selected as use nozzle lines in accordance with a state of dots which forms an image to be printed by calculating the image quality contribution rates using the dot formation rates. When the image quality contribution rates are calculated, use nozzle line candidates and non-use nozzle lines are set in a procedure which is the same as step S120*a* of the first embodiment, and subsequently, a process in step S125 and a process in step S130 are executed. When at least one use nozzle line and at least one non-use nozzle line exist (step S125: YES and step S130: YES), a set of use nozzle lines is selected from among use nozzle line candidates in accordance with a predetermined priority order in step S135.

According to the liquid ejecting apparatus 100 of the second embodiment described above, an effect which is the same as that of the first embodiment may be attained. In addition, the liquid ejecting apparatus 100 further includes the obtaining section 225 which obtains the dot formation rates which are rates of dots formed by ink ejected from the nozzle lines NL to all dots which form an image to be printed. The weight values used in calculation of the image quality contribution rates are obtained in accordance with the dot formation rates obtained by the obtaining section 225, and therefore, use nozzle lines may be appropriately selected in accordance with an image to be printed on the medium P.

C. Third Embodiment

Figure 10:
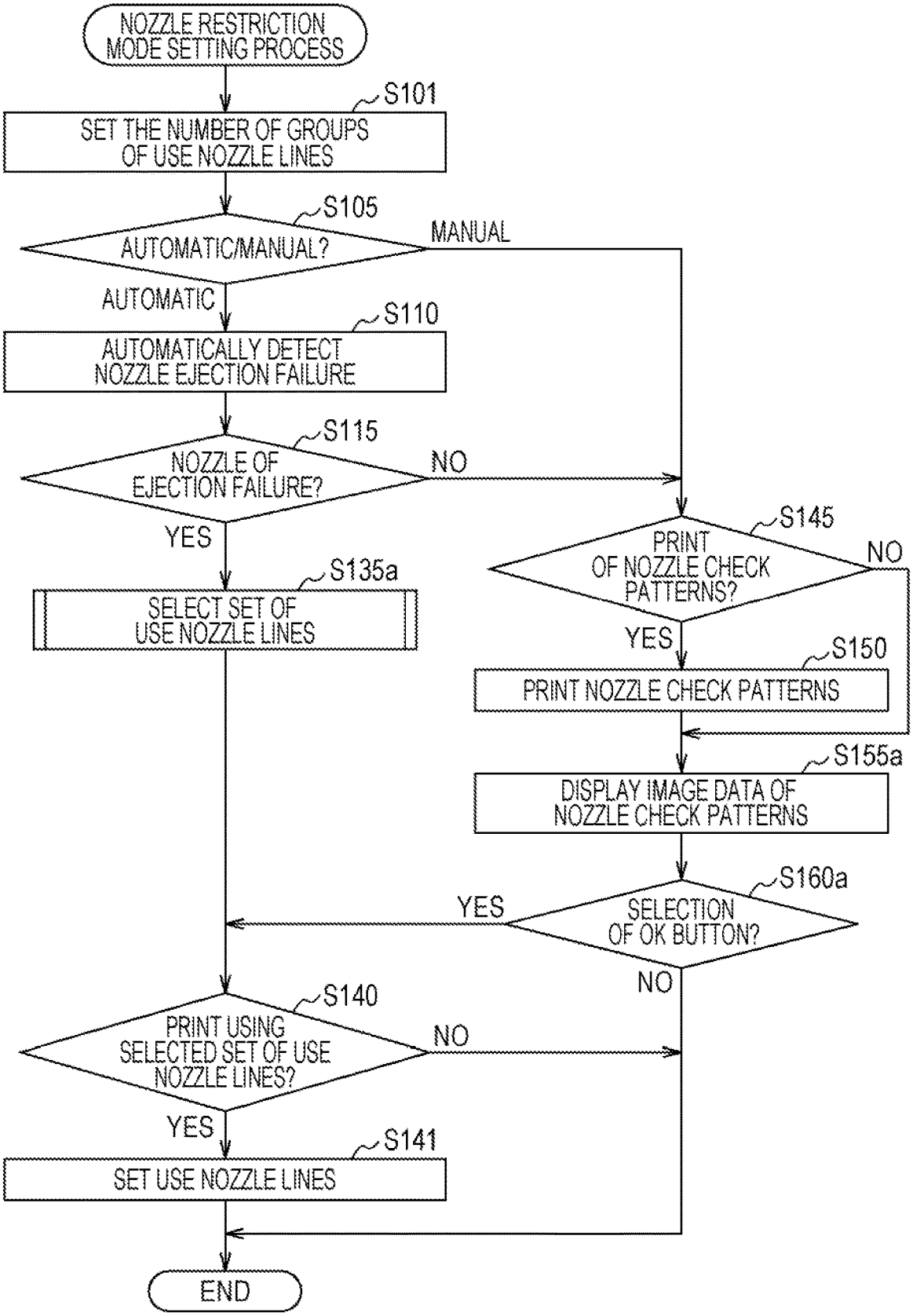
FIG. 10 is a flowchart of a processing procedure of a nozzle restriction mode setting process according to a third embodiment.

FIG. 10 is a flowchart of a processing procedure of a nozzle restriction mode setting process according to a third embodiment. The nozzle restriction mode setting process of the third embodiment is different from the nozzle restriction mode setting process of the first embodiment illustrated in FIG. 5 in that processes in step S101, step S135*a*, step S155*a*, and step S160*a* are executed and the processes in step S120, step S125, step S130, step S135, step S155, and step S160 are not executed. The other steps of the nozzle restriction mode setting process of the third embodiment is the same as those of the nozzle restriction mode setting process of the first embodiment, and therefore, the same reference numerals are assigned to the same steps and detailed descriptions thereof are omitted.

In step S101, a controller 200 sets the number of nozzle line groups to be used in a nozzle restriction mode. Specifically, four nozzle line groups Ch1 to Ch4 are provided in this embodiment, and therefore, a display section 170 displays 1, 2, or 3 as the number of nozzle line groups to be used in the nozzle restriction mode in a selectable manner. An input reception section 224 receives an input of the selection performed by the user through the operation section 175. The controller 200 sets the number of nozzle line groups to be used in the nozzle restriction mode in accordance with the received input.

When it is determined that automatic execution is to be performed in step S105 (step S105: Automatic) and nozzles Nz of ejection failure are detected in step S115 (step S115: YES), a process in step S135*a* is executed. First, a selection section 223 calculates image quality contribution rates for individual nozzle lines NL using the numbers of nozzles of ejection failure of the nozzle lines NL detected by a detection section 222 and weight values 233 of the individual ink colors described above stored in a memory 230. The image quality contribution rate is calculated in accordance with Expression (1) below.

(Image Quality Contribution Rate)=(The Number of Nozzles of Ejection Failure)×(Weight Values 233) Expression (1)

Subsequently, the selection section 223 calculates a sum of the image contribution rates of each of the nozzle line groups Ch1 to Ch4 to which the corresponding nozzle lines NL belong. Thereafter, the selection section 223 calculates a sum of the image quality contribution rates for each set of use nozzle lines corresponding to the number of nozzle line groups to be used in the nozzle restriction mode set in step S101 and sets a set of use nozzle lines which has a smallest sum of the image quality contribution rates as a set of use nozzle lines to be used in the nozzle restriction mode.

In a case where a plurality of sets of use nozzle lines have the smallest sum of image contribution rates, one of the sets which is arranged on a most downstream side in the sub-scanning direction D1 is selected. For example, in a case where the number of nozzle line groups to be used in the nozzle restriction mode is set to "2" in step S101, the selection section 223 selects sets D, E, and F of use nozzle lines illustrated in FIG. 7 as candidates of the set of use nozzle lines, calculates sums of image quality contribution rates of nozzle line groups which belong to the sets D, E, and F of use nozzle lines, and selects one of the sets of use nozzle lines having the smallest sum as a set of use nozzle lines to be used in the nozzle restriction mode. In a case where at least two sums of image quality contribution rates in the sets D, E, and F of use nozzle lines are equal to each other, the selection section 223 selects one of the sets arranged on a downstream side. For example, in a case where a sum of image quality contribution rates of the set F of use nozzle lines is larger than a sum of image quality contribution rates of the set D of use nozzle lines and a sum of image quality contribution rates of the set E of use nozzle lines and the sum of image quality contribution rates of the set D and the sum of image quality contribution rates of the set E are equal to each other, the set D of use nozzle lines is selected to be used in the nozzle restriction mode.

When it is determined that the manual execution is to be performed in step S105 (step S105: Manual), as with the first embodiment, the display section 170 displays image data representing nozzle check patterns CP in step S155*a*. Here, in this embodiment, the number of check boxes CB1 to CB4 to be checked and/or at least one of the check boxes CB1 to CB4 to be checked corresponding to the nozzle Nz determined by the user as ejection failure or corresponding to a nozzle line group to which the nozzle line NL belongs is restricted in accordance with the number of nozzle line groups to be used in the nozzle restriction mode set in step S101.

For example, when it is determined that the number of nozzle line groups to be used in the nozzle restriction mode is "3" in step S101, the check boxes CB2 and CB3 may not be checked. By this, when a plurality of nozzle line groups are to be used in the nozzle restriction mode, nozzle line groups which are consecutively adjacent to each other in the sub-scanning direction D1 are determined as a set of use nozzle lines. Thereafter, when the user checks one of the check boxes CB1 and CB4, the other of the check boxes CB1 and CB4 may not be checked. Also in a case where "2" is set as the number of nozzle line groups to be used in the nozzle restriction mode, check of the check boxes is restricted so that two nozzle line groups which are consecutively adjacent to each other in the sub-scanning direction D1 are determined as a set of use nozzle lines. In a case where "1" is set as the number of nozzle line groups to be used in the nozzle restriction mode, check on the check boxes is restricted so that one of the nozzle line groups is determined as a set of use nozzle lines.

Subsequently, when it is determined that the user has selected an OK button Bt2 in step S160*a* (step S160*a*: YES), an input by the user to the check boxes CB1 to CB4 is received by the input reception section 224 and the selection section 223 selects a set of use nozzle lines to be used in the nozzle restriction mode based on the received input. Thereafter, the process proceeds to step S140. For example, when "3" is set as the number of nozzle line groups to be used in the nozzle restriction mode in step S101 and the user checks the check box CB1 in step S155*a* and selects the OK button Bt2, the selection section 223 selects the set B of use nozzle lines illustrated in FIG. 7 as a set of use nozzle lines to be used in the nozzle restriction mode.

According to the liquid ejecting apparatus 100 of the third embodiment described above, an effect which is the same as that of the first embodiment may be attained. In addition, a set of use nozzle lines which attains least deterioration of image quality may be appropriately selected while productivity desired by the user is ensured.

D. Other Embodiments

D1. Other Embodiment 1

In the foregoing embodiments, a configuration of the liquid ejecting head 135 is not limited to a configuration illustrated in FIG. 3. For example, the number of nozzle lines NL arranged in the main scanning direction D2 and the sub-scanning direction D1 may be another arbitrary number as long as at least one nozzle line NL is included in each of the plurality of nozzle line groups Ch1 to Ch4 arranged in the sub-scanning direction D1. Specifically, the liquid ejecting head 135 has N nozzle line groups including at least one nozzle line in the sub-scanning direction D1 (N is an integer equal to or larger than 3) and at least selects nozzle line groups which are consecutively adjacent to each other in the sub-scanning direction D1 as a set of use nozzle lines. Also with this configuration, an effect which is the same as those of the foregoing embodiments may be attained.

D2. Other Embodiment 2

In the foregoing embodiments, colors of ink ejected from the nozzles Nz of the individual nozzle lines NL are not limited to the examples described above. For example, ink of the same color may be ejected from the nozzle lines CL1 and YL1 in the single first liquid ejecting chip C11. Also with this configuration, an effect which is the same as those of the foregoing embodiments may be attained.

D3. Other Embodiment 3

In step S120 and step S120*a* of the nozzle restriction mode setting process of the foregoing embodiments, the selection section 223 may add a process of calculating a sum of image quality contribution rates of use nozzle lines for each of the sets B to J of use nozzle lines illustrated in FIG. 7, and in step S135, a process of preferentially selecting a set of use nozzle lines in ascending order of a sum of image quality contribution rates of the sets B to J of the use nozzle lines may be performed instead. For example, a sum of the image quality contribution rates of the set B of use nozzle lines is an integrated value of image quality contribution rates of the nozzle line groups Ch1 to Ch3, and a sum of the image quality contribution rates of the set J of use nozzle lines is an image quality contribution rate of the nozzle line group Ch1. Note that, when a plurality of sets of use nozzle lines have the same sum of image quality contribution rates, as with the foregoing embodiments, a set which has a larger number of use nozzle lines and which is disposed on an upper stream side in the sub-scanning direction D1 is preferentially selected. By this, the nozzle restriction mode may be executed using a set of use nozzle lines which may suppress degradation of print image quality. Also with this configuration, an effect which is the same as those of the foregoing embodiments may be attained.

D4. Other Embodiment 4

In the foregoing embodiments, in step S135 of the nozzle restriction mode setting process, a process of printing the nozzle check patterns CP or at least a portion of an image to be printed on the medium P as a test pattern using a plurality of sets of use nozzle lines and selecting one of the sets of use nozzle lines to be used in printing in the nozzle restriction mode by the user may be performed instead. Note that the test pattern may be printed on a medium for a test.

For example, in a case where the nozzle line groups Ch1, Ch3, and Ch4 are set as use nozzle line candidates in step S120, step S120*a*, or step S160, the sets D, G, H, and J of use nozzle lines are candidates of a set of use nozzle lines, and therefore, the test printing is executed using the set D, G, H, and J of use nozzle lines, a screen for selecting one of the sets D, G, H, and J of use nozzle lines is displayed in a display section 170 and a selection section 223 selects one of the sets D, G, H, and J of use nozzle liens to be used in printing in the nozzle restriction mode. In this case, priority degrees, that is, recommendation degrees, of the sets of use nozzle lines illustrated in FIG. 7 may be displayed in the display section 170. Alternatively, in step S140 of the nozzle restriction mode setting process, a process of printing the nozzle check patterns CP or at least a portion of an image to be printed as a test pattern on the medium P using the selected set of use nozzle lines so that the selected set of use nozzle lines are checked may be additionally performed. By this, the user may easily select a set of use nozzle lines to be used in the nozzle restriction mode after checking print quality by test printing. As a result, usability may be improved.

D5. Other Embodiment 5

Although a set of use nozzle lines is selected using each of the nozzle line groups Ch1 to Ch4 as a selection unit and all nozzle lines NL included in the selected nozzle line group are used in the foregoing embodiments, only a number of the nozzle lines NL which belong to the selected nozzle line group may be used. In this case, rates of individual colors in the nozzle lines are required to be the same between the case where only a number of the nozzle lines NL which belong to the nozzle line group are used and the case where all the nozzle lines NL which belong to the nozzle line group are used. For example, in a case where a number of the nozzle lines CL1, YL1, ML1, KL5, KL5, ML5, YL5, and CL5 which belong to the nozzle line group Ch1 are to be used, a set which realizes "cyan:yellow:magenta:black=1:1:1:1" obtained when all the nozzle lines are used, such as a set of the nozzle lines CL1, YL1, ML1, and KL1 or a set of the nozzle lines CL1, ML1, KL5, and YL5, may be selected. Even in this configuration, an effect which is the same as that in the foregoing embodiments may be attained although the effect is smaller than that attained in the case where all the nozzle lines NL which belong to the selected nozzle line group are used.

D6. Other Embodiment 6

According to the first and third embodiments, the image quality contribution rates are calculated for individual nozzle lines NL using the numbers of nozzles of ejection failure in the individual nozzle lines NL detected by the detection section 222 and the weight values 233 of the individual ink colors described above stored in the memory 230, and according to the second embodiment, the image quality contribution rates are calculated for individual nozzle lines NL using the number of nozzles of ejection failure in the individual nozzle lines NL detected by the detection section 222 and dot formation rates obtained by the obtaining section 225. However, the number of nozzles of ejection failure in the individual nozzle lines NL detected by the detection section 222 may be determined as image quality contribution rates. Even in this configuration, an effect which is the same as those in the foregoing embodiments may be attained although the effect is smaller than that attained in the case where the weight values 233 or the dot formation rates are used.

D7. Other Embodiment 7

Although the liquid ejecting apparatus 100 is an ink jet printer of an on-carriage type in the foregoing embodiment, the present disclosure is not limited to this. For example, the liquid ejecting apparatus 100 may be an on-carriage type ink jet printer or ink tanks may be used instead of the ink cartridges 132. Furthermore, liquid ejected from the nozzles Nz may be liquid other than ink as described below.

(1) Color material used in fabrication of a color filter for an image display apparatus, such as a liquid crystal display.
(2) Electrode material used for electrode formation, such as an electro luminescence (EL) display or a field emission display (FED).
(3) Liquid including a bioorganic substance used in biochip fabrication
(4) Sample as a precision pipette
(5) Lubricant
(6) Resin liquid
(7) Transparent resin liquid, such as ultraviolet curable resin, for forming a micro-hemispheric lens used in an optical communication element or the like
(8) Acid etching liquid or alkaline etching liquid ejected for etching a substrate
(9) Arbitrary minute amount of another droplet Note that the term "droplet" means a state of liquid ejected by the liquid ejecting apparatus 100 and includes a granular shape, a teardrop shape, and a line like a long tail. Furthermore, the "liquid" herein is at least material which may be consumed by the liquid ejecting apparatus 100. For example, the "liquid" is at least material in a state in which a substance is in a liquid phase, and the "liquid" includes material of high or low viscosity in a liquid state and material in a liquid state, such as sol, gel water, other inorganic solvent, organic solvent, liquid solution, liquid resin, and liquid metal (metallic melt). Furthermore, the "liquid" includes, in addition to liquid as one state of a substance, solvent including particles of functional materials formed of solid material, such as pigment or metallic particles, dissolved therein, dispersed therein, or mixed therein. Typical examples of the liquid include ink and liquid crystal. Here, the ink includes various types of liquid composition, such as general water-based ink, general oil-based ink, gel ink, and hot-melt ink. Also with these configurations, an effect which is the same as those of the foregoing embodiments may be attained.

D8. Other Embodiment 8

In the foregoing embodiments, a number of the configurations realized by hardware may be replaced by software, or conversely, a number of the configurations realized by software may be replaced by hardware. Furthermore, in a case where a number of or all the functions of the present disclosure are realized by software, the software (computer programs) may be provided by being stored in a computer-readable recording medium. In the present disclosure, examples of the "computer-readable recording medium" include, in addition to a portable recording medium, such as a flexible disk or a compact disc read only memory (CD-ROM), an internal storage apparatus included in a computer, such as a RAM or a ROM, and an external storage apparatus fixed in a computer, such as a hard disk. Specifically, the "computer-readable recording medium" has wide meaning including an arbitrary recording medium which may not temporarily store data but which fixes data.

The present disclosure is not limited to the foregoing embodiments and may be realized by various configurations without departing from the scope of the present disclosure. For example, the technical characteristics in the embodiments corresponding to the technical characteristics in the various modes described in Summary may be replaced or combined where appropriate to solve a number of or all the problems described above or attain a number of or all the effects described above. Furthermore, if the technical characteristics are not described as essential in this specification, the technical characteristics may be appropriately eliminated.

E. Other Embodiments (1) According to an embodiment of the present disclosure, a liquid ejecting apparatus is provided. The liquid ejecting apparatus includes a liquid ejecting head having N nozzle line groups (N is an integer equal to or larger than 3) in a first direction each of which includes at least one nozzle line having a plurality of nozzles which eject liquid on a medium, a main scanning section configured to move the liquid ejecting head in a second direction which intersects with the first direction for scanning, a selection section configured to select a set of use nozzle lines to be used for formation of dots on the medium from among the N nozzle line groups, and an ejection controller configured to form the dots by causing the nozzles included in the set of use nozzle lines selected by the selection section to eject the liquid. The selection section selects M of the N nozzle line groups ($2 \leq M < N$) which are consecutively adjacent to each other in the first direction as the set of use nozzle lines.

Since the liquid ejecting apparatus includes a liquid ejecting head having N nozzle line groups (N is an integer equal to or larger than 3) in a first direction each of which includes at least one nozzle line having a plurality of nozzles which eject liquid on a medium, a main scanning section configured to move the liquid ejecting head in a second direction which intersects with the first direction for scanning, a selection section configured to select a set of use nozzle lines to be used for formation of dots on the medium from among the N nozzle line groups, and an ejection controller configured to form the dots by causing the nozzles included in the set of use nozzle lines selected by the selection section to eject the liquid, when ejection failure of the nozzles Nz is detected, printing may be continued by the liquid ejecting apparatus without stopping printing, and therefore, deterioration of productivity of printed matter may be suppressed. Furthermore, since M of the N nozzle line groups ($2 \leq M < N$) which are consecutively adjacent to each other in the first direction are selected as a set of use nozzle lines, an image may be formed by dots on the medium without performing complicated transport control while deterioration of image quality may be suppressed when compared with a configuration in which nozzle line groups which are not consecutively arranged in the sub-scanning direction D1 are selected as a set of use nozzle lines.

(2) In the liquid ejecting apparatus configured as above, the selection section may preferentially select, when a plurality of candidates of a set of use nozzle lines are detected as the set of use nozzle lines, one of the candidates of a set of use nozzle lines which has the largest number of nozzle line groups as the set of use nozzle lines.

According to the liquid ejecting apparatus of this embodiment, when a plurality of candidates of a set of use nozzle lines exist, one of the candidates of a set of use nozzle lines which has a largest number of nozzle line groups is preferentially selected as a set of use nozzle lines, and therefore, dots may be formed using a larger number of nozzle line groups when ejection failure of nozzles is detected.

(3) The liquid ejecting according to this embodiment may further include a detection section configured to detect ejection failure of the nozzles. The selection section may calculate image quality contribution rates using the numbers of nozzles of the ejection failure in the individual nozzle lines and weight values determined in advance for the individual nozzle lines in accordance with Expression (1), and the selection section may select the set of use nozzle lines based on a state of ejection failure represented by the image quality contribution rates.

$$\text{(Image Quality Contribution Rate)} = \text{(The Number of Nozzles of Ejection Failure)} \times \text{(Weight Value)} \quad \text{Expression (1)}$$

According to the liquid ejecting apparatus of this embodiment, the image quality contribution rates are calculated using the numbers of nozzles of ejection failure in the individual nozzle lines and weight values determined in advance for nozzle lines and a set of use nozzle lines is selected based on a state of ejection failure represented by the image quality contribution rates, and therefore, a set of use nozzle lines may be easily selected.

(4) According to the liquid ejecting apparatus of this embodiment, each of the N nozzle line groups may have a plurality of nozzle lines arranged in the second direction, the plurality of nozzle lines may eject the liquid of different color materials, and the weight values may correspond to density of colors of the liquid.

According to the liquid ejecting apparatus of this embodiment, the plurality of nozzle lines eject the liquid of different color materials and the weight values correspond to density of colors of the liquid, and therefore, a set of use nozzle lines may be appropriately selected in accordance with visibility of the ink on the medium.

(5) The liquid ejecting apparatus according to this embodiment may further include an obtaining section configured to obtain dot formation rates which are rates of dots formed by ink ejected from the nozzle lines to all dots which form an image to be printed, and the weight values may correspond to the dot formation rates obtained by the obtaining section.

The liquid ejecting apparatus according to this embodiment further includes an obtaining section which obtains the dot formation rates which are rates of dots formed by ink ejected from the nozzle lines to all dots which form an image to be printed. The weight values are obtained in accordance with the dot formation rates obtained by the obtaining section, and therefore, use nozzle lines may be appropriately selected in accordance with an image to be printed on the medium P.

(6) The liquid ejecting apparatus according to this embodiment may further include a display section configured to display image data indicating the N nozzle line groups and an input reception section configured to receive a selection of presence or absence of the ejection failure in the N nozzle line groups using the displayed image data. The selection section may select the set of use nozzle lines based on a state of ejection failure indicated by the selection of presence or absence of the ejection failure received by the input reception section.

Since the liquid ejecting apparatus of this embodiment further includes a display section configured to display image data indicating the N nozzle line groups and an input reception section configured to receive a selection of presence or absence of the ejection failure in the N nozzle line groups using the displayed image data, presence or absence of the ejection failure in the nozzle line groups may be easily selected using the displayed image data. Furthermore, since the selection section selects a set of use nozzle lines based on a state of ejection failure indicated by a selection of presence or absence of ejection failure received by the input reception section, a set of use nozzle lines may be easily selected.

(7) According to another embodiment of the present disclosure, there is provided a method for driving a liquid ejecting apparatus including a liquid ejecting head having N nozzle line groups (N is an integer equal to or larger than 3) in a first direction each of which includes at least one nozzle line having a plurality of nozzles which eject liquid on a medium and a main scanning section configured to move the liquid ejecting head in a second direction which intersects with the first direction for scanning. In this driving method, information indicating whether dots are to be formed on the medium only using selected nozzle line groups among the N nozzle line groups is displayed in a selectable manner, and when it is determined that the dots are to be formed, the dots are formed using a set of M of the nozzle line groups ($2 \leq M < N$) which are consecutively adjacent to each other in the first direction.

According to the driving method of this embodiment, since information indicating whether dots are to be formed on the medium only using a number of the N nozzle lines is displayed in a selectable manner, and when it is determined that the dots are to be formed, the dots are formed using a set of M of the nozzle line groups ($2 \leq M < N$) which are consecutively adjacent to each other in the first direction, degradation of image quality may be suppressed and an image may be formed by dots on a medium without performing complicated transport control when compared with a configuration in which nozzle line groups which are not consecutively arranged in the first direction are selected as the set of use nozzle lines.

(8) In the driving method of this embodiment, the dots of a test pattern may be formed on the medium using the M nozzle line groups, and an image to be printed may be formed on the medium using dots formed by the nozzle line groups used in the formation of the dots of the test pattern.

According to the driving method of this embodiment, since the dots of a test pattern are formed on the medium using the M nozzle line groups and an image to be printed is formed on the medium using dots formed by the nozzle line groups used in the formation of the dots of the test pattern, the image to be printed may be formed on the medium with image quality which is the same as that obtained when the dots of the test pattern are formed on the medium.

The present disclosure may be realized by various forms. For example, the present disclosure may be realized by various forms, such as a method for driving a liquid ejecting apparatus, a method for ejecting liquid, a computer program which realizes the methods, and a recording medium which records the computer program.

What is claimed is:

1. A liquid ejecting apparatus comprising:

a liquid ejecting head having N nozzle line groups, N being an integer of three or more, arranged in a first direction each of which includes at least one nozzle line having a plurality of nozzles which eject liquid on a medium;

a main scanning section configured to move the liquid ejecting head in a second direction which intersects with the first direction for scanning;

a selection section configured to select a set of use nozzle lines to be used for formation of dots on the medium from among the N nozzle line groups; and an ejection controller configured to control the liquid ejecting head to form the dots by ejecting the liquid from the nozzles included in the set of use nozzle lines selected by the selection section, wherein the selection section selects M groups among the N nozzle line groups which are consecutively adjacent to each other in the first direction as the set of use nozzle lines, M being equal to or larger than two and smaller than N.

2. The liquid ejecting apparatus according to claim 1, wherein the selection section preferentially selects, when a plurality of candidates of a set of use nozzle lines are detected as the set of use nozzle lines, one of the candidates of a set of use nozzle lines which has the largest number of nozzle line groups as the set of use nozzle lines.

3. The liquid ejecting apparatus according to claim 1, further comprising:

a detection section configured to detect ejection failure of the nozzles, wherein the selection section calculates image quality contribution rates using the numbers of nozzles of the ejection failure in the individual nozzle lines and weight values determined in advance for the individual nozzle lines in accordance with Expression (1), $$\text{(Image Quality Contribution Rate)} = \text{(The Number of Nozzles of Ejection Failure)} \times \text{(Weight Value)} \quad \text{Expression (1)}$$

and the selection section selects the set of use nozzle lines based on a state of ejection failure represented by the image quality contribution rates.

4. The liquid ejecting apparatus according to claim 3, wherein each of the N nozzle line groups has a plurality of nozzle lines arranged in the second direction, the plurality of nozzle lines eject the liquid of different color materials, and the weight values correspond to density of colors of the liquid.

5. The liquid ejecting apparatus according to claim 3, further comprising:

an obtaining section configured to obtain dot formation rates which are rates of dots formed by ink ejected from the nozzle lines to all dots which form an image to be printed, wherein the weight values correspond to the dot formation rates obtained by the obtaining section.

6. The liquid ejecting apparatus according to claim 1, further comprising:

a display section configured to display image data indicating the N nozzle line groups; and an input reception section configured to receive a selection of presence or absence of the ejection failure in the N nozzle line groups using the displayed image data, wherein the selection section selects the set of use nozzle lines based on a state of ejection failure indicated by the selection of presence or absence of the ejection failure received by the input reception section.

7. A method for driving a liquid ejecting apparatus including a liquid ejecting head having N nozzle line groups, N being an integer of three or more, arranged in a first direction each of which includes at least one nozzle line having a plurality of nozzles which eject liquid on a medium and a main scanning section configured to move the liquid ejecting head in a second direction which intersects with the first direction for scanning, the method comprising:

displaying information indicating whether dots are to be formed on the medium only using selected nozzle line groups among the N nozzle line groups in a selectable manner; and forming the dots on the medium using a set of M groups among the N nozzle line groups which are consecutively adjacent to each other in the first direction, M being equal to or larger than two and smaller than N, when it is determined that the dots are formed on the medium only using the selected nozzle lines.

8. The driving method according to claim 7, the method further comprising:

forming the dots of a test pattern on the medium using the M nozzle line groups; and forming an image to be printed on the medium using dots formed by the nozzle line groups used in the formation of the dots of the test pattern.

* * * * *